US008261923B2

(12) United States Patent
Blanchard

(10) Patent No.: US 8,261,923 B2
(45) Date of Patent: Sep. 11, 2012

(54) COLLAPSIBLE CONTAINER

(75) Inventor: Wesley J. Blanchard, Charlotte, NC (US)

(73) Assignee: Otto Industries North America, Inc., Parsippany, NJ (US)

( * ) Notice: Subject to any disclaimer, the term of this patent is extended or adjusted under 35 U.S.C. 154(b) by 483 days.

(21) Appl. No.: 12/427,927

(22) Filed: Apr. 22, 2009

(65) Prior Publication Data

US 2009/0261092 A1 Oct. 22, 2009

Related U.S. Application Data

(60) Provisional application No. 61/046,851, filed on Apr. 22, 2008.

(51) Int. Cl.
*B65D 6/18* (2006.01)

(52) U.S. Cl. ..... 220/6; 220/7; 220/4.28

(58) Field of Classification Search ..... 220/6, 7, 220/4.28; 16/386

See application file for complete search history.

(56) References Cited

U.S. PATENT DOCUMENTS

| | | | |
|---|---|---|---|
| 3,952,367 | A | 4/1976 | Schnelle et al. |
| 4,081,099 | A | 3/1978 | Shead |
| 4,163,495 | A | 8/1979 | Drader |
| 4,181,236 | A | 1/1980 | Prodel |
| 4,349,120 | A | 9/1982 | DiNardo |
| 4,693,387 | A | 9/1987 | Stonier |
| 4,775,069 | A | 10/1988 | Stonier |
| 4,798,304 | A | 1/1989 | Rader |
| 4,820,383 | A | 4/1989 | Shchamorov et al. |
| 4,852,213 | A | 8/1989 | Shewchuk |
| 4,854,475 | A | 8/1989 | Riihimaki et al. |
| 4,913,302 | A | 4/1990 | Stonier |
| 4,940,155 | A | 7/1990 | Hewson |
| 4,953,735 | A | 9/1990 | Tisbo et al. |
| 4,960,223 | A | 10/1990 | Chiang et al. |
| 5,062,671 | A | 11/1991 | Goetz et al. |
| 5,075,927 | A | 12/1991 | Porta |
| 5,121,877 | A | 6/1992 | Bodary et al. |
| D355,073 | S | 2/1995 | Junaedi |
| 5,398,834 | A | 3/1995 | Umiker |
| 5,429,261 | A | 7/1995 | Machino |
| 5,515,987 | A | 5/1996 | Jacques et al. |
| 5,556,658 | A | 9/1996 | Raudalus et al. |
| 5,622,012 | A | 4/1997 | Schijf |
| 5,622,276 | A | 4/1997 | Simmons |
| 5,632,392 | A | 5/1997 | Oh |
| D381,513 | S | 7/1997 | Brauner |
| 5,671,857 | A | 9/1997 | Stromberg |
| 5,699,926 | A | 12/1997 | Jacques et al. |
| 5,727,711 | A | 3/1998 | Emond et al. |
| 5,742,980 | A | 4/1998 | Nitta |
| 5,746,342 | A | 5/1998 | Jacques et al. |

(Continued)

*Primary Examiner* — Stephen Castellano
(74) *Attorney, Agent, or Firm* — Alston & Bird LLP

(57) ABSTRACT

A collapsible container is provided that incorporates various features for improving the stability of the container and for reducing damage to the items carried by the container. The container may include a stabilizing hinge assembly including a stabilizing ledge and a stabilizing hook that securely engage the respective sidewalls to the base of the container to stiffen the container and distribute the loads more evenly. The sidewalls and base of the container may also define contact areas to support the carried items without bruising or damaging the items. Non-contact areas of the container that do not come into contact with the items may include openings that are aligned with other openings in the container and other adjacent containers to provide a consistent flow of air through a number of containers stacked beside one another. The sidewalls may also include various latching features to maintain the container in the expanded configuration.

28 Claims, 31 Drawing Sheets

U.S. PATENT DOCUMENTS 5,797,508 A 8/1998 Loftus et al.
5,829,617 A 11/1998 Umiker
5,853,099 A 12/1998 Lessard
5,967,356 A 10/1999 Laarhoven et al.
5,975,324 A 11/1999 Schmitt
5,988,420 A 11/1999 Jacques et al.
5,992,664 A 11/1999 Trapp et al.
6,015,056 A 1/2000 Overholt et al.
6,029,840 A 2/2000 Brauner
D423,217 S 4/2000 Varfeldt
D424,299 S 5/2000 Varfeldt
6,073,790 A 6/2000 Umiker
6,098,827 A 8/2000 Overholt et al.
6,131,757 A 10/2000 Clark et al.
6,138,851 A 10/2000 Townson
6,189,695 B1 2/2001 Ching-rong
6,209,741 B1 4/2001 Boucher-Giles
6,209,742 B1 4/2001 Overholt et al.
D446,392 S 8/2001 Overholt et al.
6,286,701 B1 9/2001 Umiker
6,290,081 B1 9/2001 Merey
6,293,417 B1 9/2001 Varfeldt
6,293,418 B1 9/2001 Ogden et al.
D452,614 S 1/2002 Overholt
6,386,388 B1 5/2002 Overholt
D458,753 S 6/2002 Overholt et al.
6,398,054 B1 6/2002 Overholt et al.
6,405,888 B1 6/2002 Overholt et al.
6,409,041 B1 6/2002 Overholt et al.
6,446,825 B1 9/2002 Godoy
6,460,717 B1 10/2002 Smyers et al.
6,499,188 B1 12/2002 Cheng
6,601,724 B1 8/2003 Koefelda et al.
6,631,822 B1 10/2003 Overholt
D481,542 S 11/2003 Leisch
6,669,044 B2 12/2003 Murakami et al.
6,722,516 B1 4/2004 Zelko
6,772,897 B2 8/2004 Kellerer et al.
6,820,761 B1 11/2004 Mouri et al.
6,863,180 B2 3/2005 Apps et al.
6,899,242 B2 5/2005 Overholt et al.
6,918,502 B1 7/2005 Overholt et al.
7,017,765 B2 3/2006 Overholt
7,017,766 B2 3/2006 Hsu et al.
7,044,319 B2 5/2006 Overholt et al.
7,048,134 B1 5/2006 Hagan
7,048,135 B2 5/2006 Smyers et al.
7,059,489 B2 6/2006 Apps et al.
7,086,555 B2 8/2006 Overholt et al.
7,100,786 B2 9/2006 Smyers
7,104,414 B2 9/2006 Apps et al.
7,175,040 B2 2/2007 Lorenz et al.
7,195,127 B2 3/2007 Hsu et al.
7,234,630 B2 6/2007 Wang
2005/0040166 A1 2/2005 Nolet et al.
2008/0203089 A1 8/2008 Hartwall
2008/0276358 A1 11/2008 Allen et al.

ENLARGED VIEW

ENLARGED VIEW

COLLAPSIBLE CONTAINER

CROSS-REFERENCE TO RELATED APPLICATIONS

The present application claims the benefit of U.S. Provisional Application No. 61/046,851, entitled "Collapsible Container," filed on Apr. 22, 2008, the contents of which are incorporated herein in their entirety.

FIELD OF THE INVENTION

The present invention is directed to assemblies for storing and transporting items, and more particularly to a collapsible container including structural components and features configured to provide increased stability of the container and allow for the storage and transportation of damage-sensitive items, such as bananas and other products.

BACKGROUND

Collapsible containers are conventionally used for storing and shipping various items. Collapsible containers can be collapsed (i.e., folded into a relatively flat configuration) for space-efficient storage and can also be expanded (i.e., folded from a collapsed position to a usable position) to define a relatively rigid structure for holding and protecting goods. For example, food items, such as loose or packaged fruits, vegetables, meat, and other products may be shipped from a distribution center to a retail establishment using such collapsible containers.

Collapsible containers typically define a base and four sidewalls. The four sidewalls are generally hingedly connected to the base such that the sidewalls can be rotated between collapsed and expanded positions. During use, in the expanded position, collapsible containers are routinely stacked one atop the next with goods stored in one container positioned in close, stacked proximity to goods stored in an adjacent container.

Applicant has identified a number of deficiencies and problems associated with the manufacture, design, and use of conventional collapsible containers. Through applied effort, ingenuity, and innovation, Applicant has solved many of these identified problems by developing a solution that is embodied by the present invention, which is described in detail below.

BRIEF SUMMARY

The present invention addresses the above needs and achieves other advantages by providing a collapsible container incorporating structures and components for improving the stability, rigidity, and performance of the container.

In one embodiment, a collapsible container is provided having a collapsed configuration and an expanded configuration. The collapsible container includes a base defining a plurality of base edges and a plurality of walls. Each wall is configured to hingedly engage a corresponding one of the base edges such that each wall is rotatable about the corresponding base edge, and at least one of the base edges defines a stabilizing ledge. At least one of the walls defines a stabilizing hook configured to securely engage the stabilizing ledge when the collapsible container is in the expanded configuration.

The stabilizing ledge may include an undercut portion defining a first engagement surface and a ledge extension defining a first support surface. Furthermore, the stabilizing hook may include a hook portion defining a second engagement surface and a hook extension defining a second support surface. The hook portion of the stabilizing hook may be configured to engage the undercut portion of the stabilizing ledge such that the first engagement surface engages the second engagement surface, and the hook extension of the stabilizing hook may be configured to engage the ledge extension of the stabilizing ledge such that the first support surface engages the second support surface.

In some cases, the first engagement surface and the first support surface are configured to engage the second engagement surface and the second support surface, respectively, substantially simultaneously. Furthermore, each wall may be configured to hingedly engage a corresponding one of the base edges such that each wall is rotatable about a corresponding hinge axis, and the stabilizing hook may be configured to engage the stabilizing ledge at a location distal from the base with respect to the corresponding hinge axis. In addition, the stabilizing ledge may extend substantially continuously along the length of the base edge, and the stabilizing hook may extend substantially continuously along the length of the stabilizing ledge.

The container may also include a hinge connection configured to provide the hinged engagement between one of the plurality of walls and one of the base edges. The base edge may further define stabilizing ledges on first and second sides of the hinge connection, and the respective wall may define stabilizing hooks on first and second sides of the hinge connection. In addition, each wall may define a stabilizing hook, and each base edge may define a stabilizing ledge. Moreover, each wall may be configured to hingedly engage a corresponding one of the base edges such that each wall is rotatable about a corresponding hinge axis, and the stabilizing hook may be configured to engage the corresponding stabilizing ledge when the wall defining the stabilizing hook is rotated about the corresponding hinge axis.

In another embodiment, a stabilizing hinge assembly is provided that includes a hinge, a stabilizing ledge, and a stabilizing hook. The hinge includes a hinge member and a hinge receiver configured to receive the hinge member. The engagement of the hinge receiver with the hinge member defines a hinge axis. The stabilizing ledge is fixedly connected to one of the hinge member and the hinge receiver, and the stabilizing hook is fixedly connected to the other of the hinge member and the hinge receiver. Furthermore, the stabilizing hook is configured to securely engage the stabilizing ledge when the stabilizing hook is rotated about the hinge axis to a first position, and the stabilizing hook is configured to disengage the stabilizing ledge when the stabilizing hook is rotated about the hinge axis to a second position.

In some cases, the stabilizing ledge includes an undercut portion defining a first engagement surface and a ledge extension defining a first support surface. The stabilizing hook may include a hook portion defining a second engagement surface and a hook extension defining a second support surface. The hook portion of the stabilizing hook may be configured to engage the undercut portion of the stabilizing ledge such that the first engagement surface engages the second engagement surface, and the hook extension of the stabilizing hook may be configured to engage the ledge extension of the stabilizing ledge such that the first support surface engages the second support surface.

The first engagement surface and the first support surface may be configured to engage the second engagement surface and the second support surface, respectively, substantially simultaneously. Furthermore, the stabilizing ledge and the stabilizing hook may extend along first and second sides of the hinge. The stabilizing ledge and the stabilizing hook may extend substantially continuously along the first and second sides of the hinge.

In other embodiments, a container is provided that includes a base and a number of walls coupled to the base to form an enclosure for carrying items. At least one of the walls defines a contact area that is substantially continuous and is configured to contact the items carried by the container, and a non-contact area. Furthermore, the wall defines at least one opening only in the non-contact area that is configured to provide ventilation for the items.

The contact area of at least one of the walls may be contoured to substantially match a packaging contour of the items carried by the container. In addition, the contact area may be smooth. In some cases, the non-contact area may be located proximate hinge connections whereby the walls are coupled to the base.

The base may further define an interior surface and an exterior surface, and the interior surface of the base may define a contact area that is substantially continuous and configured to contact the items carried by the container, and a base non-contact area. In addition, the base may define at least one opening in the non-contact area of the base configured to provide ventilation for the items. The contact area of the base may be substantially smooth.

In some cases, the opening(s) of the base may be substantially aligned with the opening(s) of the wall such that a vent flow channel is defined between the wall(s) and the base. Furthermore, the container may define a total surface area and a total open area including the opening of the base and the opening(s) of at least one of the walls. The total open area may be between approximately 5% and 10% of the total surface area. For example, total open area may be approximately 6% of the total surface area.

In addition, the base may define an interior portion defined on the interior surface of the base and an exterior portion defined on the exterior surface of the base. The interior portion of the base contact area may be structured to contact the items carried by the container, and the exterior contact portion may be structured to contact items carried by an adjacent container. Furthermore, the interior and exterior portions of the base contact area may be substantially smooth and substantially continuous to reduce the incidence of damage to items carried by the container and to items carried by the adjacent container. In some cases, the interior portion of the base contact area may define a generally concave contour relative to the items carried by the container, and the exterior portion of the base contact area may define a generally convex contour relative to the items carried by the adjacent container. The one or more openings of the base may be defined through the interior and exterior portions of the base non-contact area, and a plurality of stiffening ribs may be defined in the exterior portion of the base non-contact area.

In other embodiments, a container is provided for carrying stored items that collectively define a packaging contour, where the stored items include a damage-resistant portion and a damage-sensitive portion. The container includes a base and a number of walls coupled to the base to form an enclosure for carrying the items. The base and walls are contoured to match a packaging contour of the stored items. Furthermore, the base is configured such that stored items contacted by the base are contacted proximate the damage-resistant portions and are generally not contacted proximate the damage-sensitive portions.

In some cases, the container may have an internal container width of between approximately 15 and 17 inches, an internal container length of between approximately 19 and 21 inches, and an internal container height of between approximately 8.5 and 10.5 inches. For example, the container may have an internal container width of approximately 15.9 inches, an internal container length of approximately 19.9 inches, and an internal container height of approximately 9.5 inches. The container may further define an external footprint of approximately 16 inches in width by 20 inches in length by 9.66 inches in height.

The interior surface of each of the base and walls may define a contact area configured to contact the items, and the contact areas may be smooth. Alternatively or additionally, the contact areas may be substantially continuous. Furthermore, the exterior surface of the base may define a contact area configured to contact items carried by a second container stacked adjacent to the base, and the contact area of the exterior surface may be smooth.

In still other embodiments, an assembly of containers may be provided, where each container is configured for carrying at least one item. Each container of the assembly includes a base and a number of walls coupled to the base to form an enclosure for carrying the items. Each wall defines a continuous contact area configured to contact the items carried by the respective container and a non-contact area, and each wall further defines at least one opening in the non-contact area. In addition, the openings of each container are aligned with the openings of adjacent containers such that when a plurality of containers is in a stacked configuration, the openings cooperate to define vent flow channels through the stacked configuration.

In some cases, the openings of each container are aligned with the openings of adjacent containers. In this way, when a plurality of stacks of containers is positioned in a side-by-side configuration, the openings allow air to flow through each adjacent container in a direction parallel to the plane of the base of the respective containers.

In other embodiments, a collapsible container having a collapsed configuration and an expanded configuration is provided. The container includes a base defining a plurality of edges, a first pair of opposed walls, and a second pair of opposed walls. Each wall has a hinged edge configured to hingedly engage a corresponding edge of the base and an upper edge opposite the hinged edge. Furthermore, each wall of the first wall pair has two opposed first latching edges substantially perpendicular to the hinged edge and defines a thickness, and each first latching edge defines at least one latching protrusion extending along substantially the entire thickness of the respective wall. Likewise, each wall of the second wall pair has two opposed second latching edges substantially perpendicular to the hinged edge, and each wall of the second wall pair defines at least one latching receiver configured to receive a corresponding latching protrusion of the adjoining wall of the first wall pair when the container is in the expanded configuration. In addition, the latching receiver is disposed a distance from the second latching edge of the respective wall.

The protrusion may have a "T"-shaped cross-section, and/or the protrusion may be configured to slidingly engage the corresponding latching receiver. Furthermore, the first latching edges may include more than one latching protrusion, and the second latching edges may include more than one latching receiver. At least one of the latching protrusions may be configured to be received by the corresponding latching receiver proximate an exterior surface of the respective wall of the first wall pair, and at least one of the latching protrusions may be configured to be received by the corresponding latching receiver proximate an interior surface of the respective wall of the first wall pair.

In still other embodiments, the container includes a base defining a number of edges, a first pair of opposed walls and a second pair of opposed walls. Each wall has a hinged edge configured to hingedly engage a corresponding edge of the base and an upper edge opposite the hinged edge. Furthermore, each wall of the first wall pair has two opposed first latching edges substantially perpendicular to the hinged edge, and each first latching edge defines a latch tab proximate an interior surface of the respective wall extending in a plane substantially parallel to the plane defined by the interior surface. Similarly, each wall of the second wall pair has two opposed second latching edges substantially perpendicular to the hinged edge, and each wall of the second wall pair defines a tab slot located a distance from the second latching edge substantially equal to the thickness of the adjoining wall of the first wall pair, where the tab slot is configured to receive the latch tab of the adjoining wall of the first wall pair when the container is in the expanded configuration. In this way, an inwardly directed force applied at a mid-portion of the first wall pair proximate the upper edge of the walls of the first wall pair when the container is in the expanded configuration may serve to urge the latch tab into further engagement with the respective tab slot and maintain the container in the expanded configuration.

In some cases, the tab slot defined by the wall of the second wall pair may be located a distance from the second latching edge that is greater than the thickness of the adjoining wall of the first wall pair. Furthermore, each wall of the first wall pair may define a handle. The latch tab may be configured to disengage from the respective tab slot when pressure is applied to an exterior surface of the respective wall of the first wall pair proximate the location of the latch tab.

BRIEF DESCRIPTION OF THE SEVERAL VIEWS OF THE DRAWINGS

Reference is now made to the accompanying drawings, which are not necessarily drawn to scale, and wherein.

DETAILED DESCRIPTION OF THE INVENTION

A number of embodiments of the present invention now will be described more fully hereinafter with reference to the accompanying drawings, in which some, but not all embodiments of the inventions are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Various embodiments of the invention are directed to a collapsible container incorporating structures and components for improving the stability, rigidity, and performance of the collapsible container. Other embodiments include container structures and components adapted to improve the interaction between the container itself and a stored item. For example, in one embodiment, the collapsible container may be structured to reduce the incidence of bruising and other damage imparted by the container to damage-sensitive items carried within the container. In another example, the collapsible container may be structured to provide consistent air flow or ventilation to one or more stored items.

Stabilizing Hinge Assembly

Figure 1:
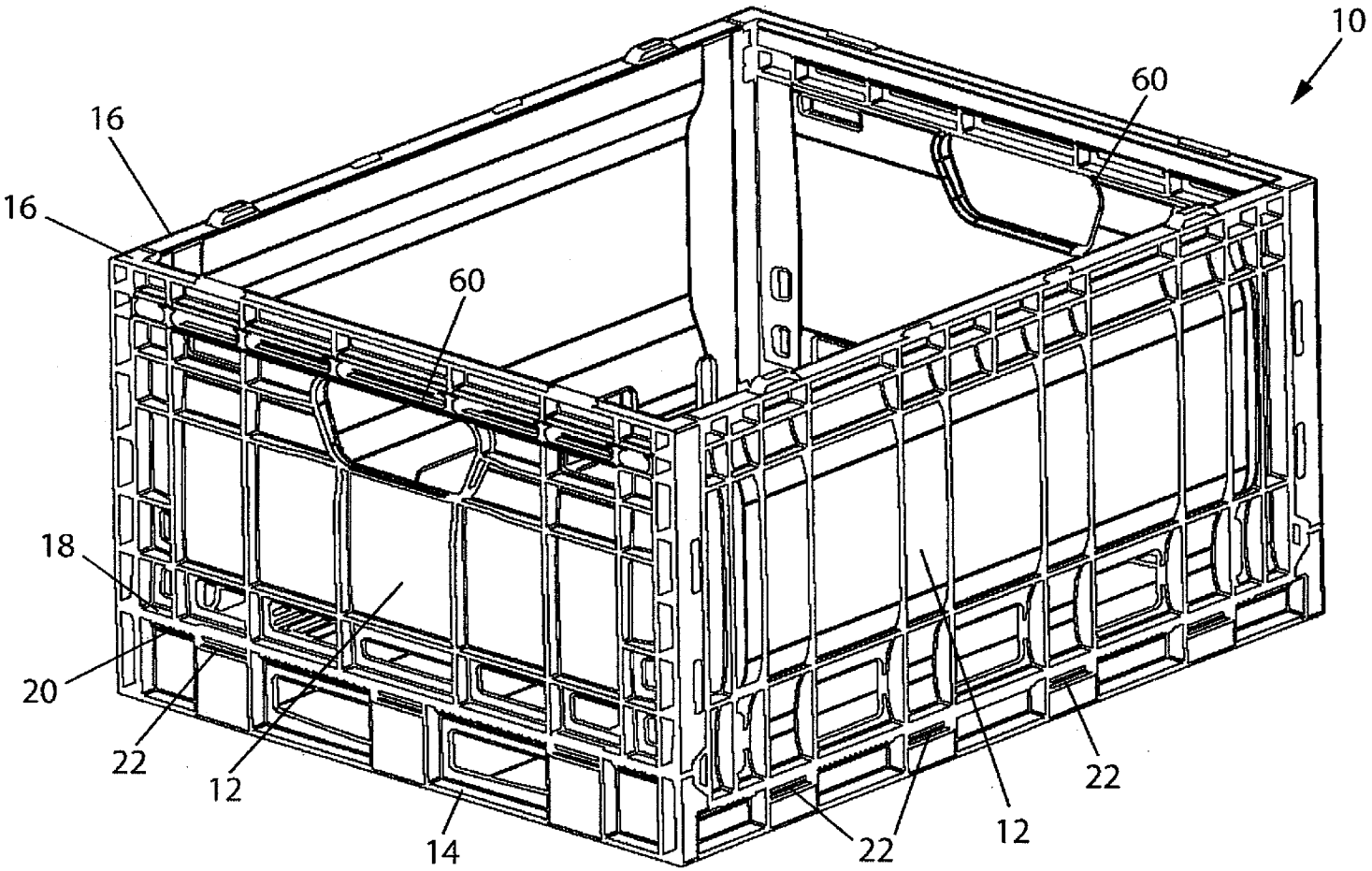
FIG. 1 is a perspective view of a collapsible container in an expanded configuration in accordance with one embodiment of the invention.

FIG. 1 illustrates a collapsible container 10 structured in accordance with various embodiments of the invention. The depicted collapsible container 10 includes a base 14 and a plurality of sidewalls 12. The sidewalls 12 define bottom edges 18 that are hingedly coupled to edges 20 of the base 14 so that the container 10 is configurable between a collapsed configuration and an expanded configuration (as shown in FIG. 1). The interface between the sidewalls 12 and the base 14 may be referred to as a hinged connection 22. The sidewalls 12 define inter-locking or inter-engageable side edges 16 that are structured, when locked or engaged, to maintain the container 10 in the expanded configuration. Handles 60 are provided in opposed sidewalls 12 so that the container 10 may be readily grasped and lifted by a user.

Figure 2:
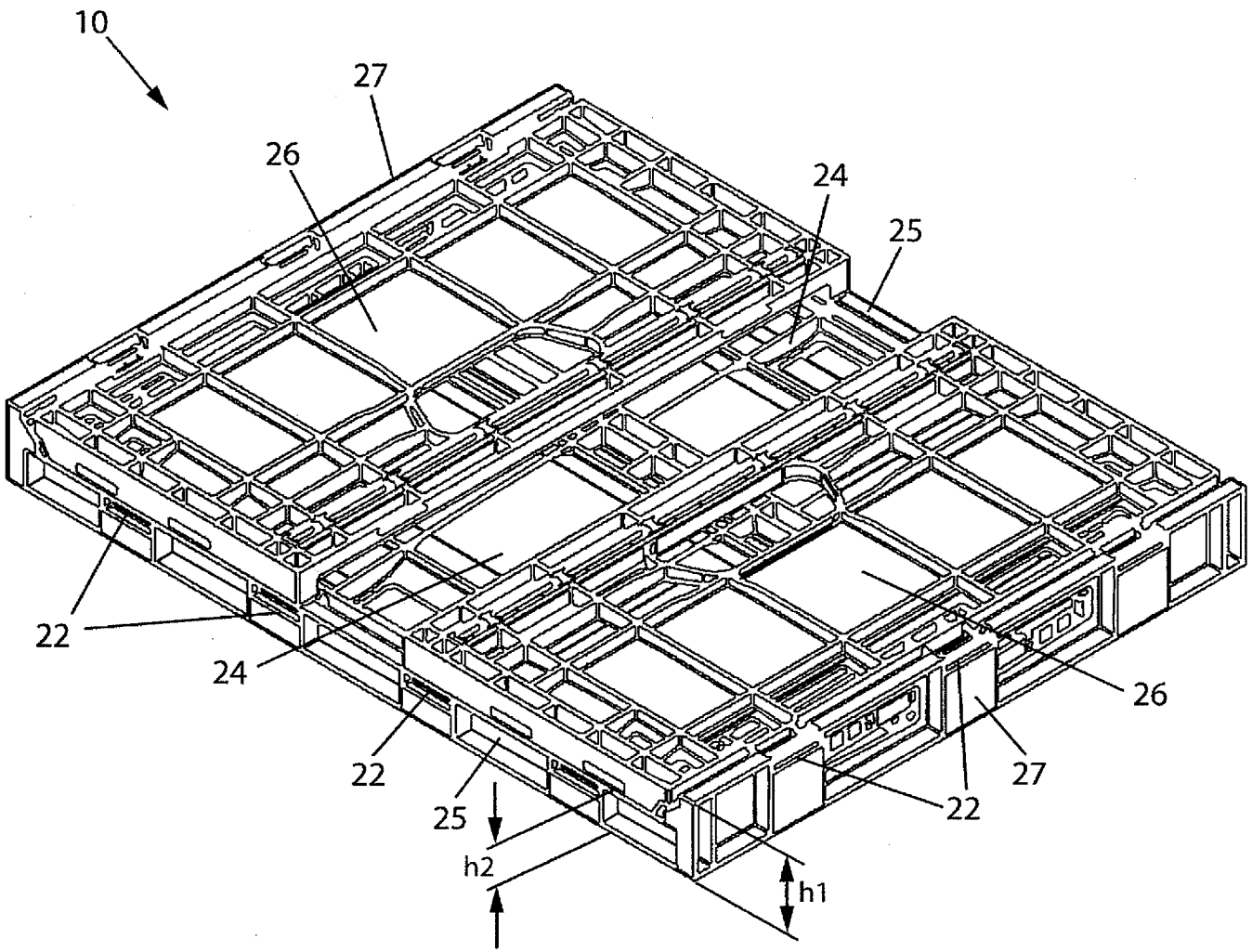
FIG. 2 is a perspective view of a collapsible container in a collapsed configuration in accordance with one embodiment of the invention.

FIG. 2 shows the container 10 in a collapsed configuration, in which the sidewalls 12 are rotated about the hinged connections 22 to rest in a generally coplanar arrangement atop the base 14 as shown. For example, a first pair of opposed walls 24 is hingedly coupled to corresponding first base edges 25, and a second pair of opposed walls 26 is hingedly coupled to corresponding second base edges 27. In the depicted embodiment, the second base edges 27 define a height h1 that is greater than the height h2 of the first base edges 25. In this way, the first pair of opposed sidewalls 24 may be rotated about respective hinged connections 22 to a collapsed position adjacent the base 14, and the second pair of opposed sidewalls 26 may be rotated about respective hinged connections 22 to a collapsed position adjacent the collapsed first pair of opposed sidewalls 24. As will be apparent to one of skill in the art in view of this disclosure, the increased height h1 of the second base edges 27 allows the second pair of opposed sidewalls 26 to clear the collapsed first pair of opposed sidewalls 24, resulting in a more compact and generally planar collapsed configuration.

Figure 3:
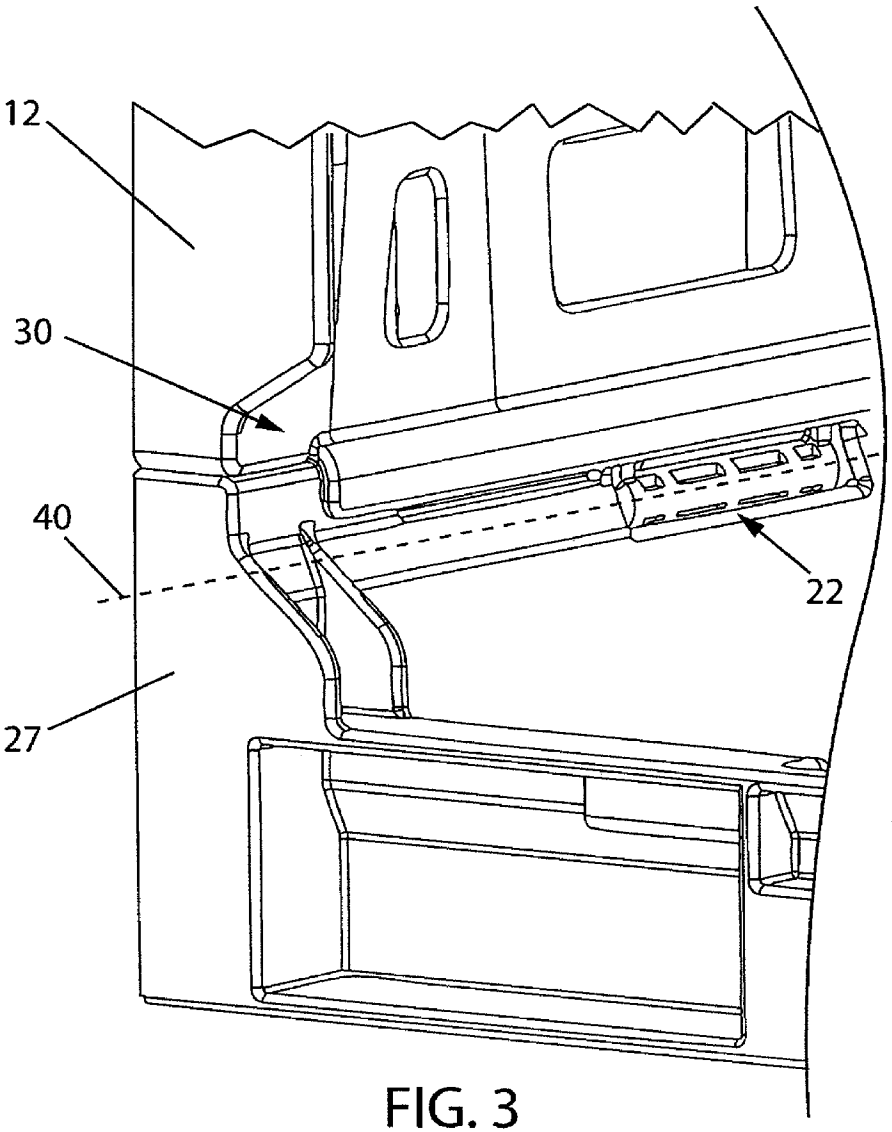
FIG. 3 is a detail perspective view of a stabilizing hinge assembly of the collapsible container of FIG. 1.

FIG. 3 illustrates a stabilizing hinge assembly 30 structured in accordance with one embodiment of the invention. For illustration purposes, the stabilizing hinge assembly is depicted as part of a collapsible container. However, stabilizing hinge assemblies as discussed herein may be incorporated into various other products and devices that include a hinged connection, such as carrying cases, laptop computers, mobile phones, laundry hampers, or any other products that would benefit from having a stabilized hinge assembly.

In the depicted embodiment, the stabilizing hinge assembly 30 is structured to provide a broader and more stable engagement between the sidewall 12 and the base edges 25, 27. In this way, lifting loads that may otherwise have resulted in stress concentrations at the hinged connections 22 may be distributed more broadly along the length of the stabilizing hinge assembly 30. In another embodiment, as will be described in greater detail below, the stabilizing hinge assembly 30 serves to stiffen or transfer rigidity between the sidewalls 12 and the base 14, further increasing the stability of the container 10.

Figure 4:
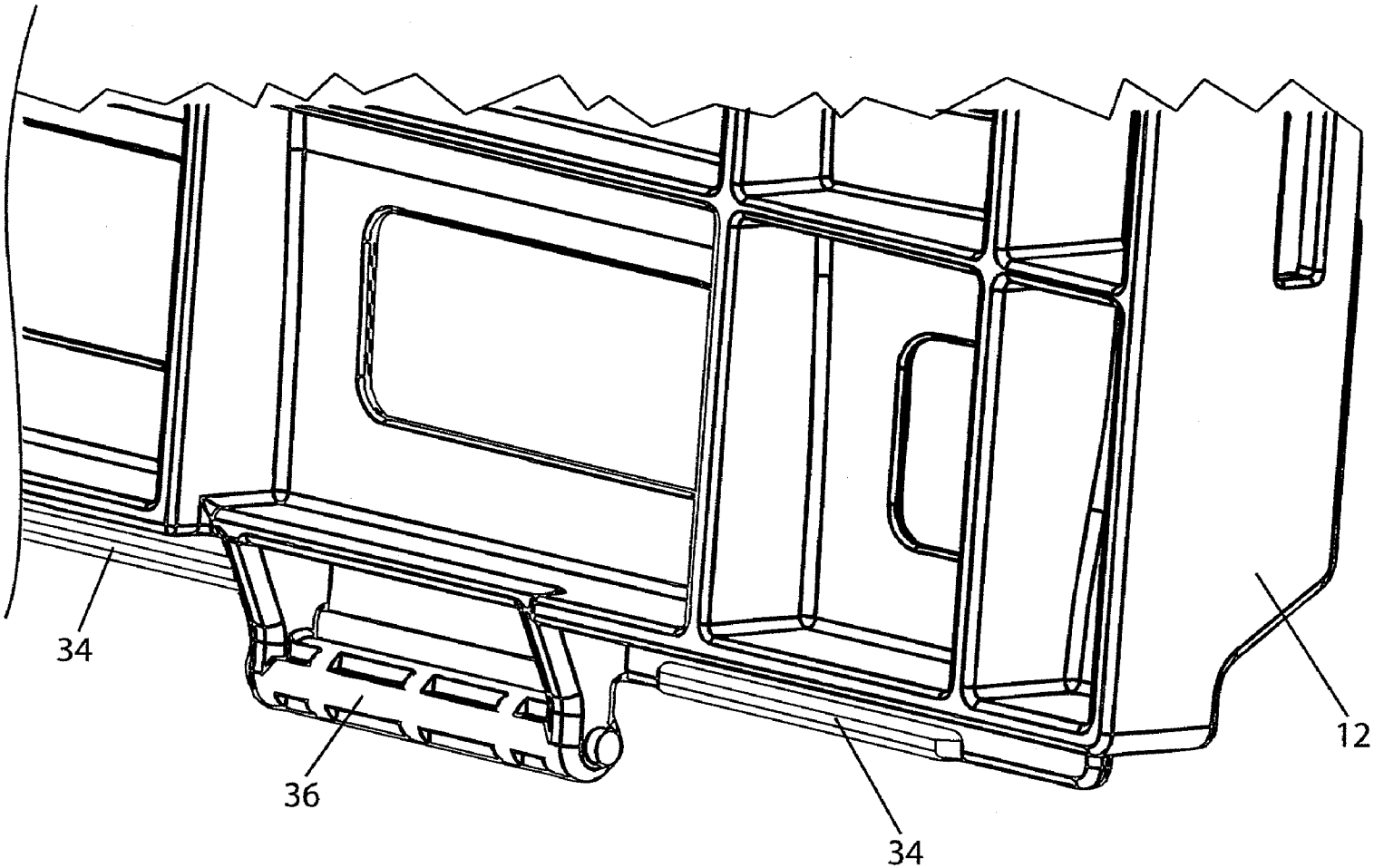
FIG. 4 is a detail perspective view of a stabilizing hook of the stabilizing hinge assembly of FIG. 3.
Figure 5:
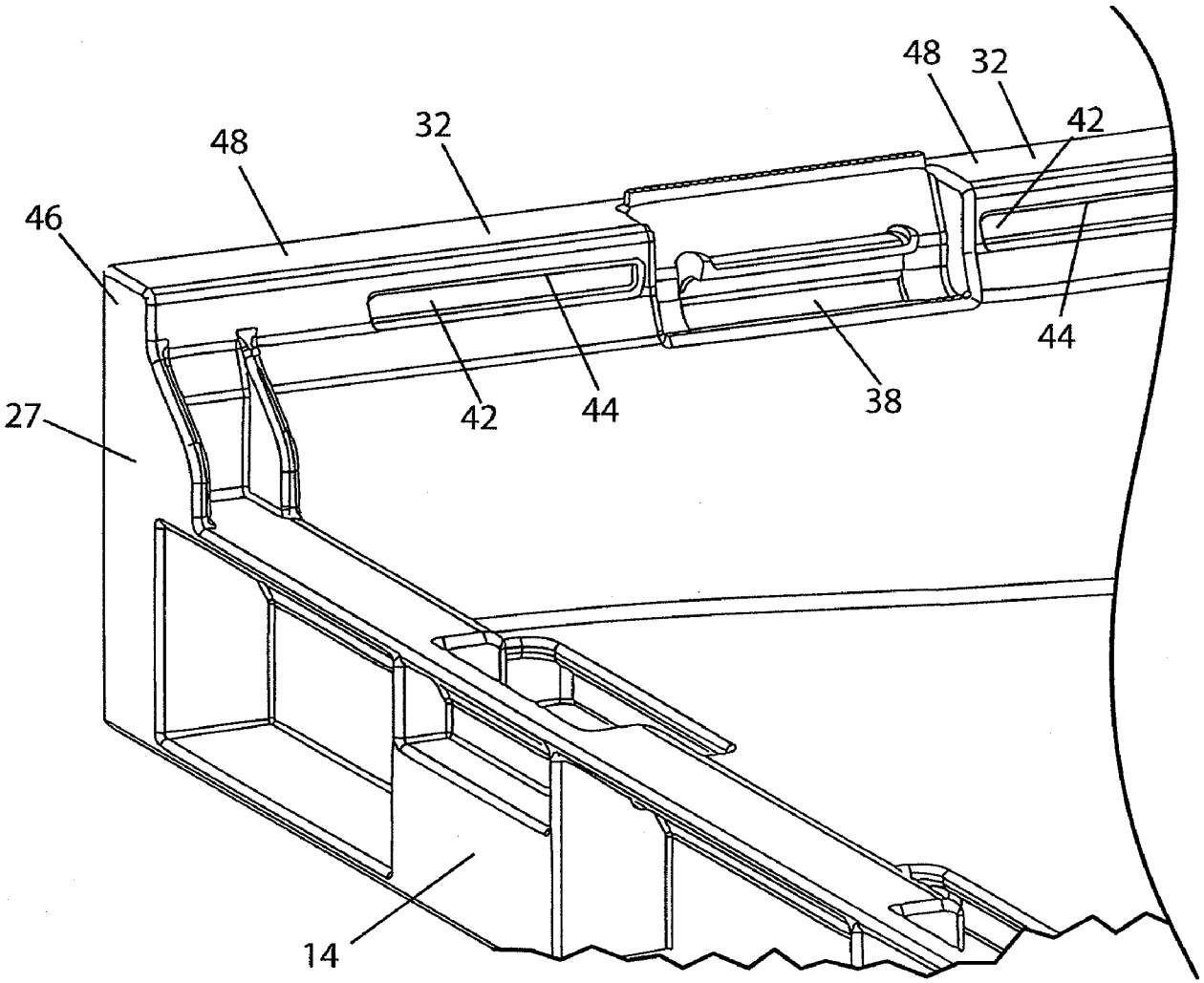
FIG. 5 is a detail perspective view of a stabilizing ledge of the stabilizing hinge assembly of FIG. 3.

With reference to FIGS. 3, 4, and 5, in one embodiment, the stabilizing hinge assembly 30 includes a hinge 22, a stabilizing ledge 32, and a stabilizing hook 34. The hinge 22 includes a hinge member 36 and a hinge receiver 38 configured to receive the hinge member 36 such that rotating engagement between the hinge receiver 38 and the hinge member 36 defines a hinge axis 40 about which the respective sidewall 12 may rotate.

The stabilizing ledge 32 is fixedly connected to one of the hinge member 36 and the hinge receiver 38. Similarly, the stabilizing hook 34 is fixedly connected to the other of the hinge member 36 and the hinge receiver 38. In the example shown in FIG. 5, the stabilizing ledge 32 is fixedly connected to (e.g., integrally formed with) the base 14, which also forms the hinge receiver 38. Thus, the base edge 27 shown in FIGS. 3 and 5 is a stabilizing base edge that defines the stabilizing ledge 32. As shown in FIG. 4, the stabilizing hook 34 of the depicted example is fixedly connected to (e.g., integrally formed with) the sidewall 12. The stabilizing hook 34 is configured to securely engage the stabilizing ledge 32 when the stabilizing hook 34 is rotated about the hinge axis 40 to a first position (e.g., an expanded configuration in the example shown) and is configured to disengage the stabilizing ledge 32 when the stabilizing hook 34 is rotated about the hinge axis 40 to a second position (e.g., a collapsed configuration or an intermediate position between the expanded configuration of FIG. 1 and the collapsed configuration of FIG. 2).

The stabilizing hook 34 may be configured to engage the stabilizing ledge 32 at a location generally displaced from the base 14 with respect to the hinge axis 40, as shown in FIG. 3. In the case of an upright container, partially illustrated in FIG. 3, the stabilizing hook 34 would thus engage the stabilizing ledge 32 along a plane positioned generally above the hinge axis 40.

Figure 6:
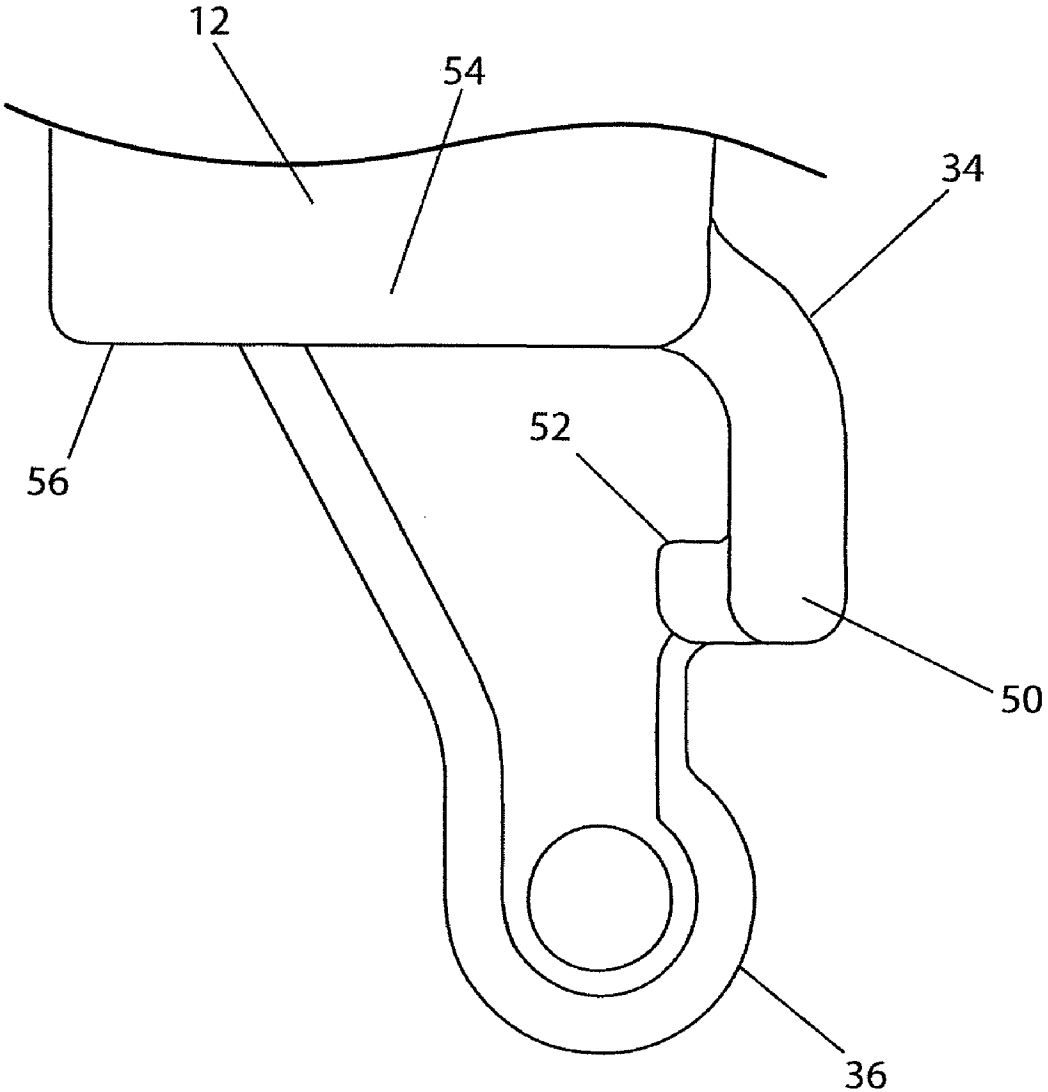
FIG. 6 is a side view of the stabilizing hook of FIG. 4.
Figure 7A:
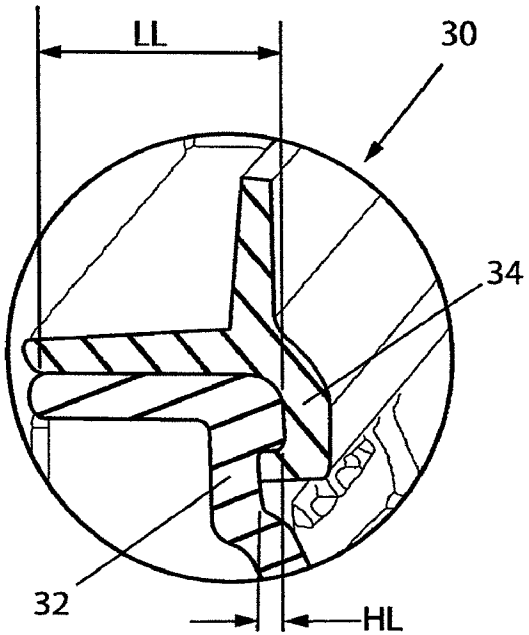
FIG. 7A is a detail cross-sectional view of the stabilizing hinge of FIG. 7.
Figure 7:
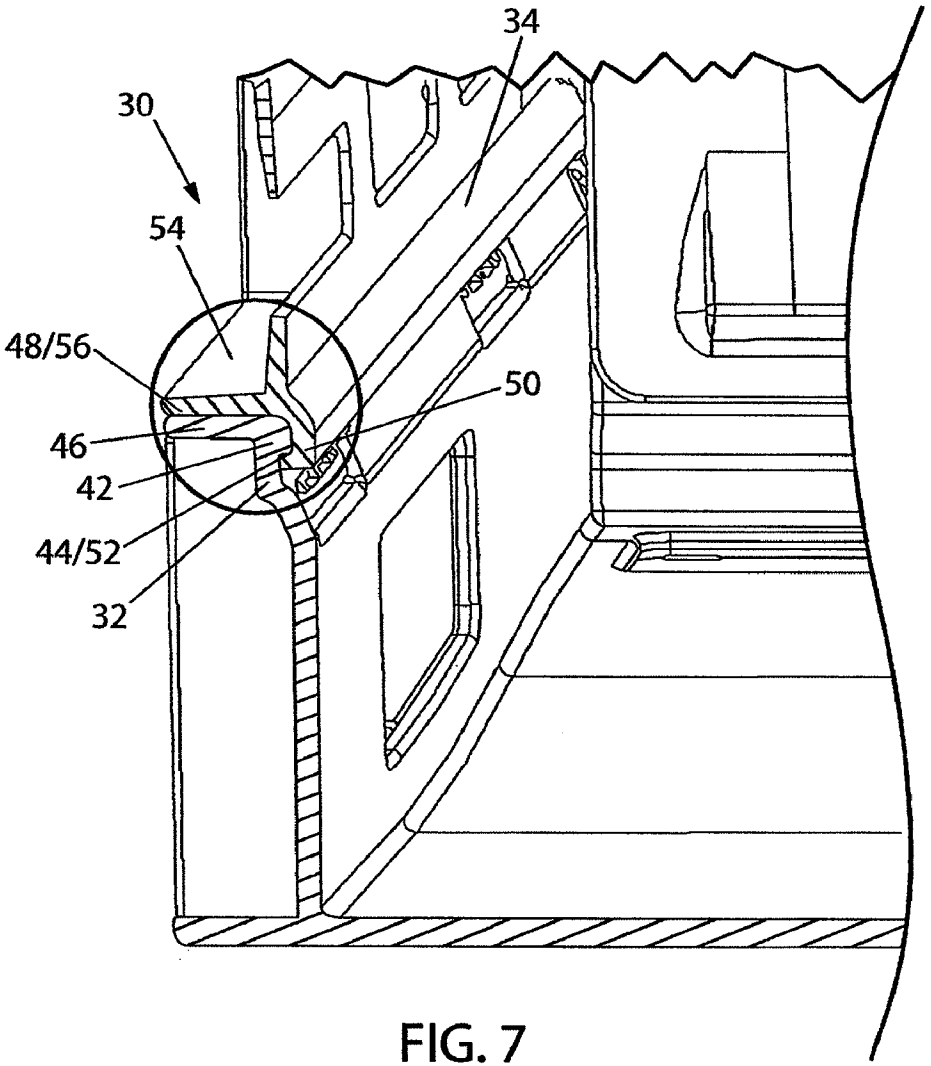
FIG. 7 is a perspective view of a cross-section of the stabilizing hinge assembly of FIG. 3.
Figure 8:
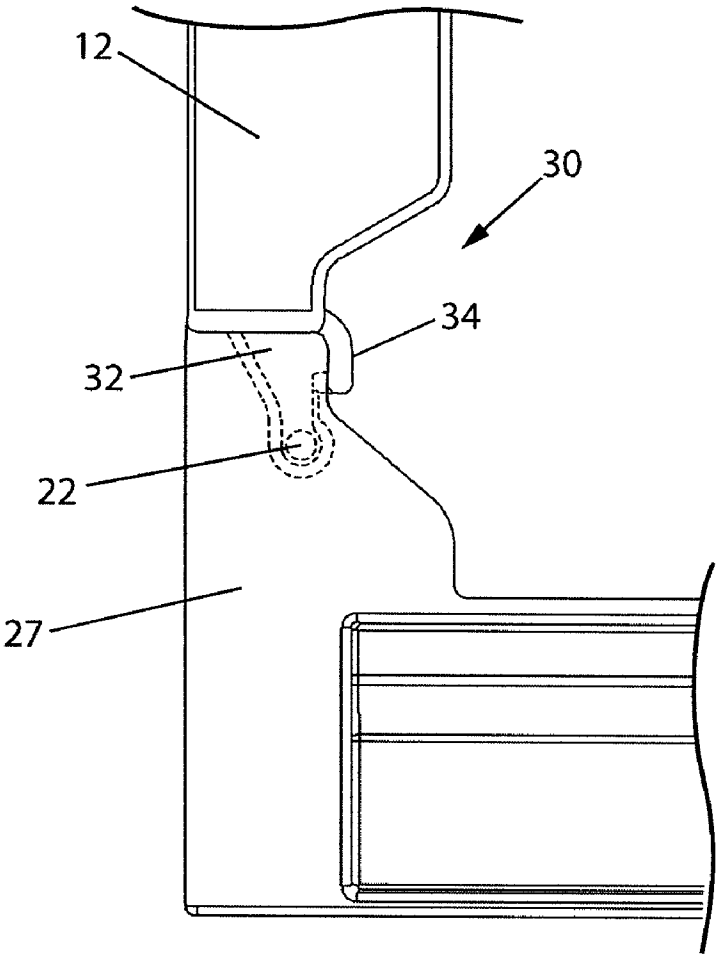
FIG. 8 is a side view of the stabilizing hinge assembly of FIG. 3.
Figure 9:
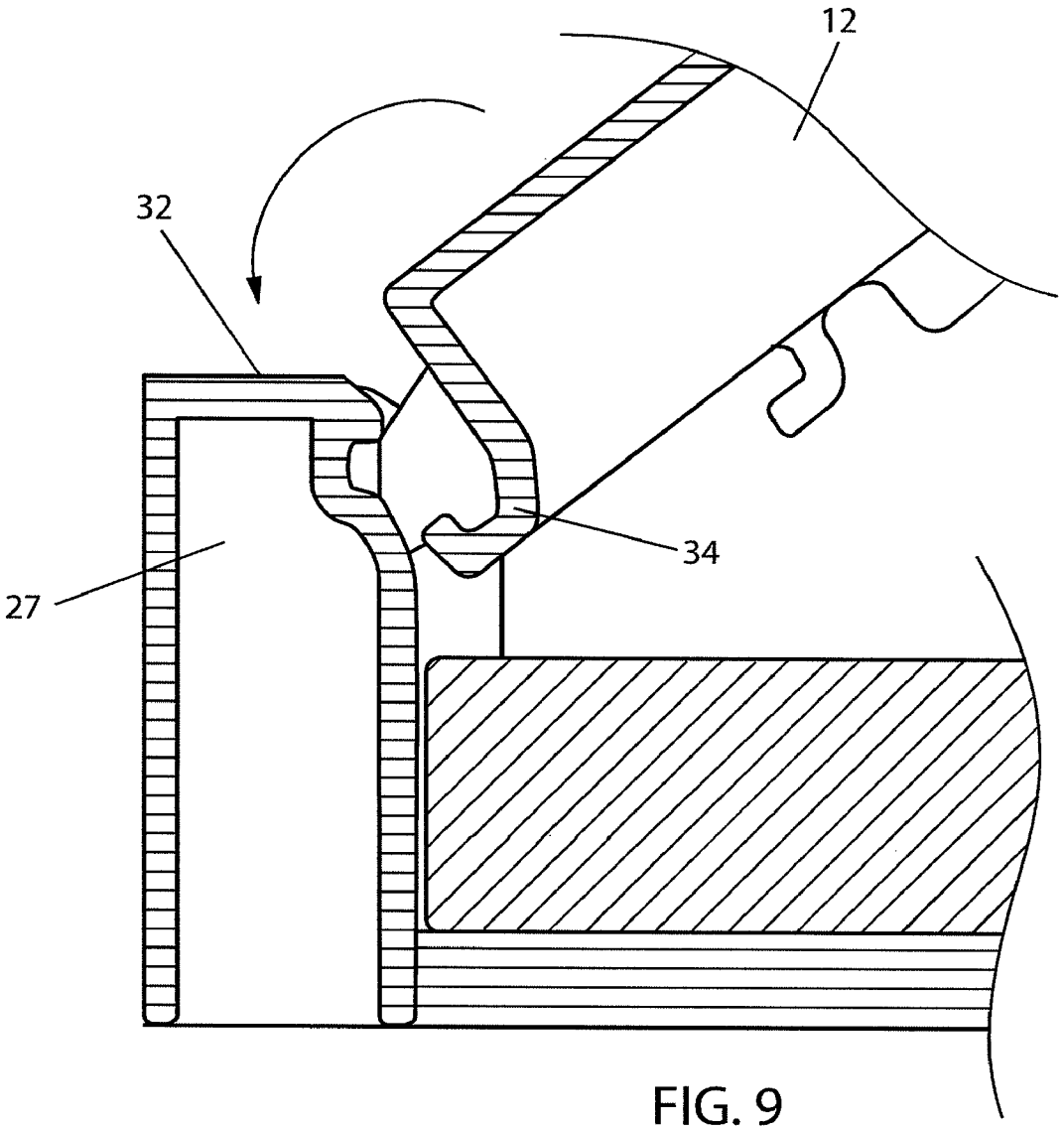
FIG. 9 is a side view of the stabilizing hinge assembly of FIG. 8 in an intermediate configuration (between the expanded and collapsed configurations of the collapsible container)

In some embodiments, the stabilizing ledge 32 comprises an undercut portion 42 defining a first engagement surface 44, and a ledge extension 46 defining a first support surface 48 as shown in FIGS. 5 and 7. The stabilizing hook 34 may thus include a hook portion 50 defining a second engagement surface 52, and a hook extension 54 defining a second support surface 56 as shown in FIG. 6. The hook portion 50 of the stabilizing hook 34 may be configured to engage the undercut portion 42 of the stabilizing ledge 32 such that the second engagement surface 52 engages the first engagement surface 44. Furthermore, the hook extension 54 of the stabilizing hook 34 may be configured to engage the ledge extension 46 of the stabilizing ledge 32 such that the first support surface 48 engages the second support surface 56. FIGS. 7 and 8 provide an exemplary illustration of the engagement between the stabilizing ledge 32 and the stabilizing hook 34 in accordance with one embodiment.

In this regard, the undercut portion 42 may be configured in different ways. For example, the undercut portion 42 may be defined by a notch or groove in the respective base edge 27, as shown in FIGS. 3 and 5. Similarly, the undercut 42 may be formed such that the first engagement surface 44 is substantially perpendicular to the stabilizing ledge 32, as pictured in FIG. 7A, or such that the stabilizing ledge 32 is oriented at an angle greater than or less than approximately 90° (not shown). In any of these configurations, however, the undercut portion 42 is sized and shaped to receive the hook portion 50 of the stabilizing hook 34 in order to adequately engage the first and second engagement surfaces 44, 52.

Stabilizing hinge assemblies 30 structured in accordance with various embodiments of the invention provide a number of benefits to a collapsible container, or other hinged apparatus, as will be recognized by one skilled in the art in light of the present disclosure. For example, the depicted stabilizing hinge assembly 30 provides a latch or positive stop for preventing over rotation (i.e., over opening) of the sidewalls 12 relative to the base 14. The depicted stabilizing hinge assembly 30 includes a stabilizing hook 34 that better distributes vertical or lift forces along the base 14 (i.e., provides additional sidewall-to-base attachment points) when such forces are applied to the sidewalls 12 (e.g., through lifting of the container), thereby reducing the likelihood that stresses associated with such forces will be focused at the hinged connections 22. The depicted stabilizing hinge assembly 30 creates a more continuous bearing surface between the sidewalls 12 and the base edges 25, 27 when the container 10 is in the expanded configuration. As a result, and as will be apparent to one of skill in the art in view of this disclosure, the depicted stabilizing hinge assembly 30 improves the torsional stiffness of the container 10 when in the expanded configuration.

Referring to FIGS. 7 and 7A, in some embodiments, the first engagement surface 44 and the first support surface 48 of the stabilizing ledge 32 are configured to engage the second engagement surface 52 (point one) and the second support surface 56 (point two) of the stabilizing hook 34, respectively, substantially simultaneously. This configuration may be referred to herein as a "two point attachment" configuration that is provided by a stabilizing hinge assembly 30 structured in accordance with embodiments of the invention.

Figure 10:
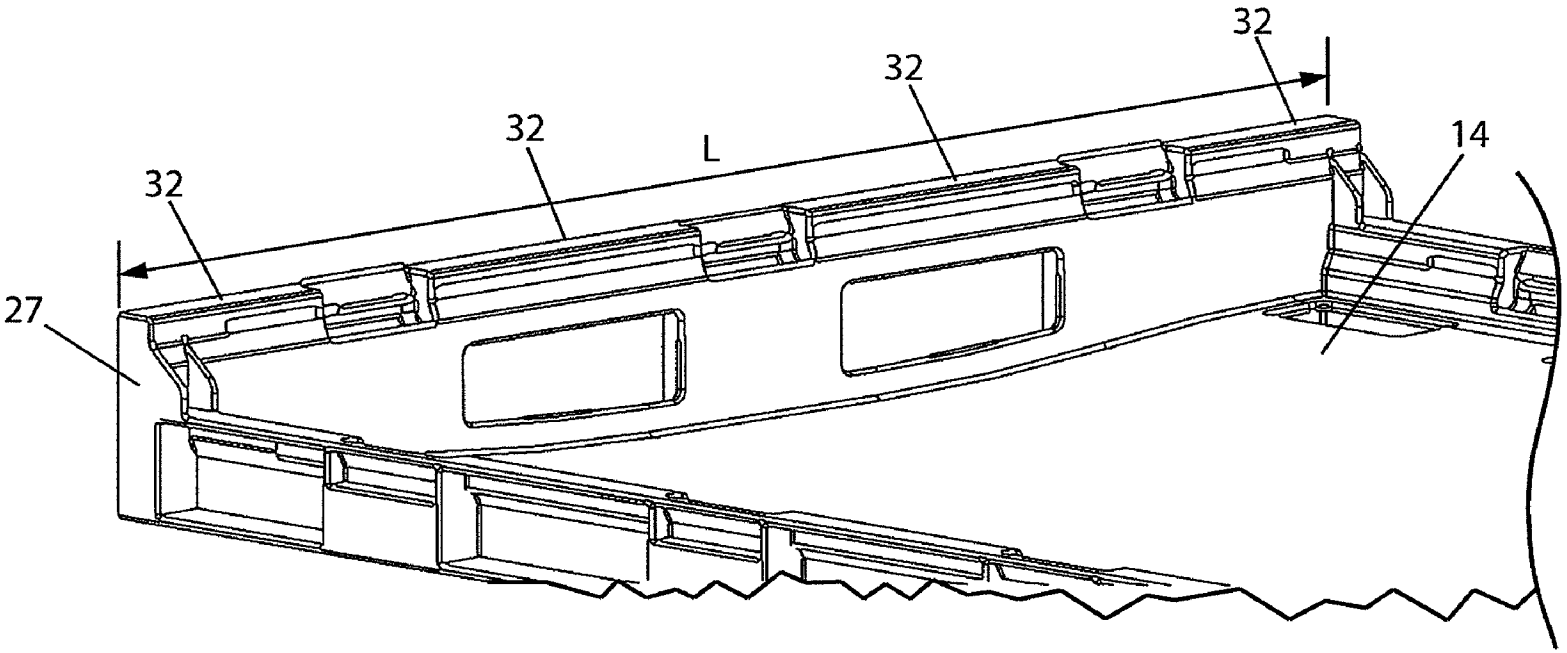
FIG. 10 is a perspective view of a stabilizing ledge that extends substantially continuously along a base edge of the container in accordance with one embodiment of the invention.
Figure 11:
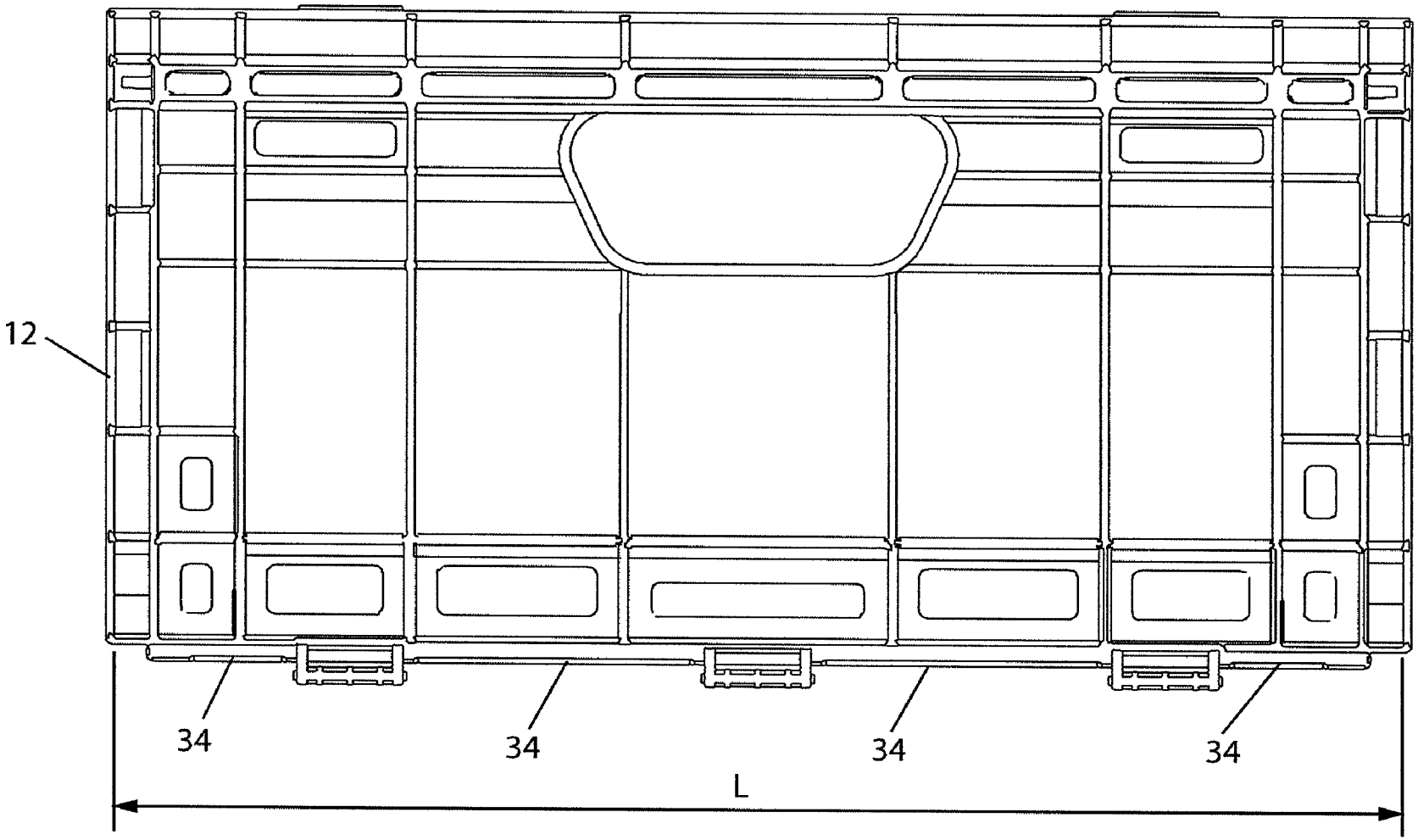
FIG. 11 is a perspective view of a stabilizing hook that extends substantially continuously along the base edge of the container in accordance with one embodiment of the invention.

The stabilizing effect of the depicted stabilizing hinge assembly 30 may be augmented by increasing the areas of engagement defined by the stabilizing ledge 32 and the stabilizing hook 34. For example, as shown in FIG. 7A, in one embodiment, the ledge length LL defined between the first support surface 48 of the stabilizing ledge 32 and the second support surface 56 of the stabilizing hook 34 may be increased. In another embodiment, the hook length HL defined between the first engagement surface 44 of the stabilizing ledge 32 and the second engagement surface 52 of the stabilizing hook 34 may be increased. In still other embodiments, the stabilizing ledge 32 and/or the stabilizing hook 34 may be structured to extend substantially continuously along the length L of the base edges 25, 27 as shown in FIGS. 10 and 11. In other embodiments, the stabilizing ledge 32 and/or stabilizing hook 34 may be structured to extend completely continuously (i.e., no breaks for hinge connection cavities) along the length L of the base edges 25, 27 (not shown). In still other embodiments, discrete stabilizing ledges and/or stabilizing hooks may be intermittently dispersed along the length L of the base edges 25, 27. For example, such discrete stabilizing ledges and/or stabilizing hooks may be positioned on opposite sides of some base feature, such as the hinge connections 22.

Container Configuration

Figure 12:
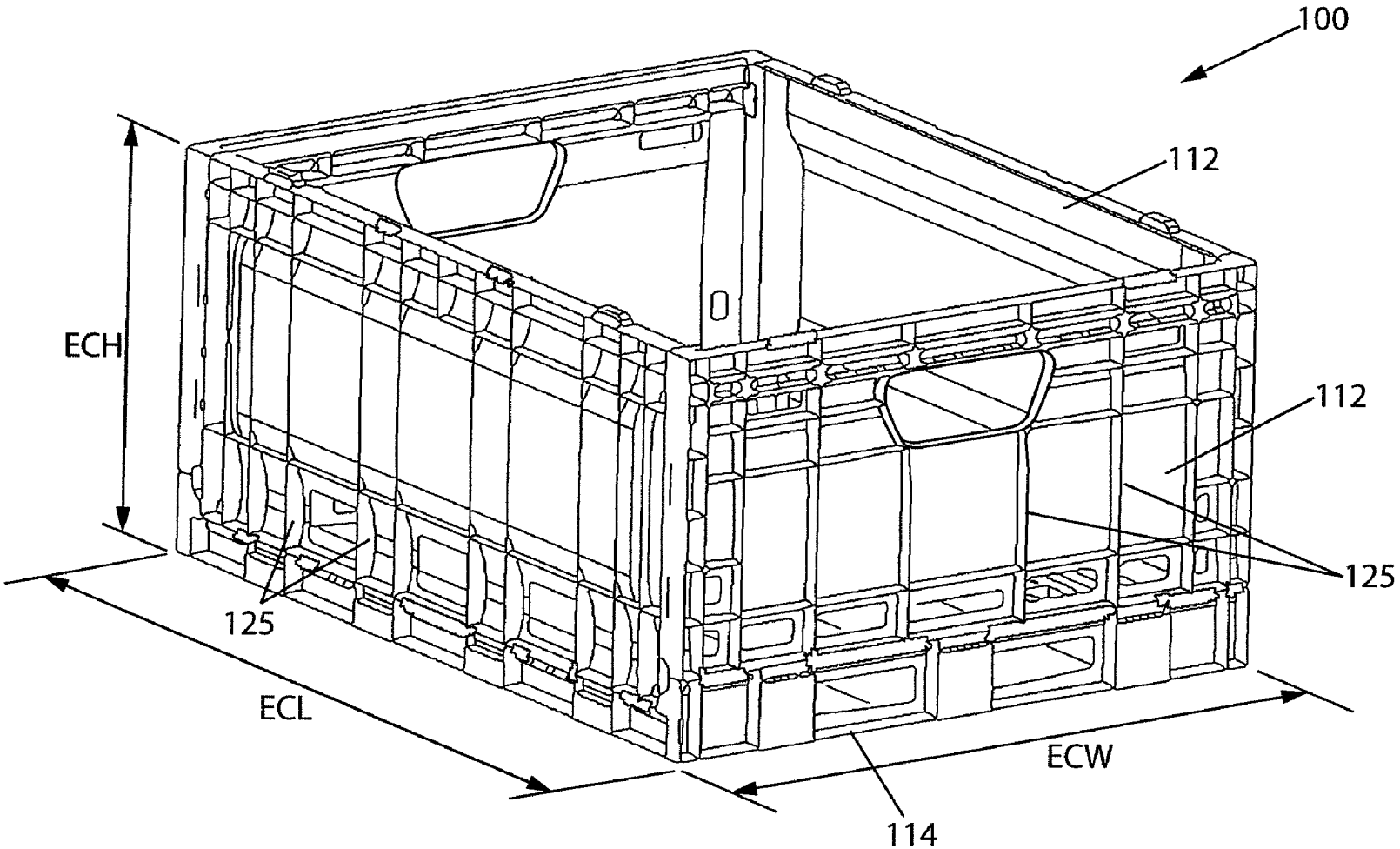
FIG. 12 is a perspective view of a collapsible container in an expanded configuration in accordance with another embodiment of the invention.

FIG. 12 depicts a collapsible container 100 structured in accordance with another embodiment of the invention. The depicted container 100 (shown in an expanded configuration) is configured for storing and transporting damage-sensitive items. In the case of shipping fruit, for example, the collapsible container 100 may be used for shipping the fruit from distribution centers to retail stores in a manner that allows the fruit to ripen evenly while also reducing the incidence of fruit damage and bruising.

Figure 13:
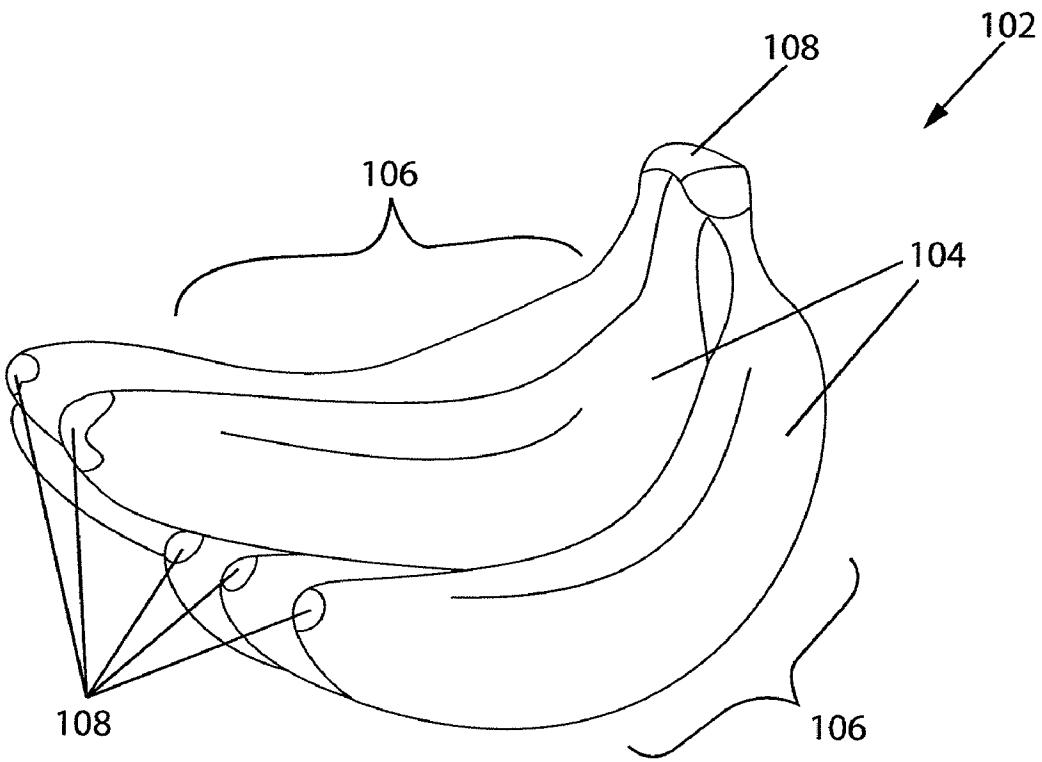
FIG. 13 is a perspective view of a cluster of bananas.
Figure 14:
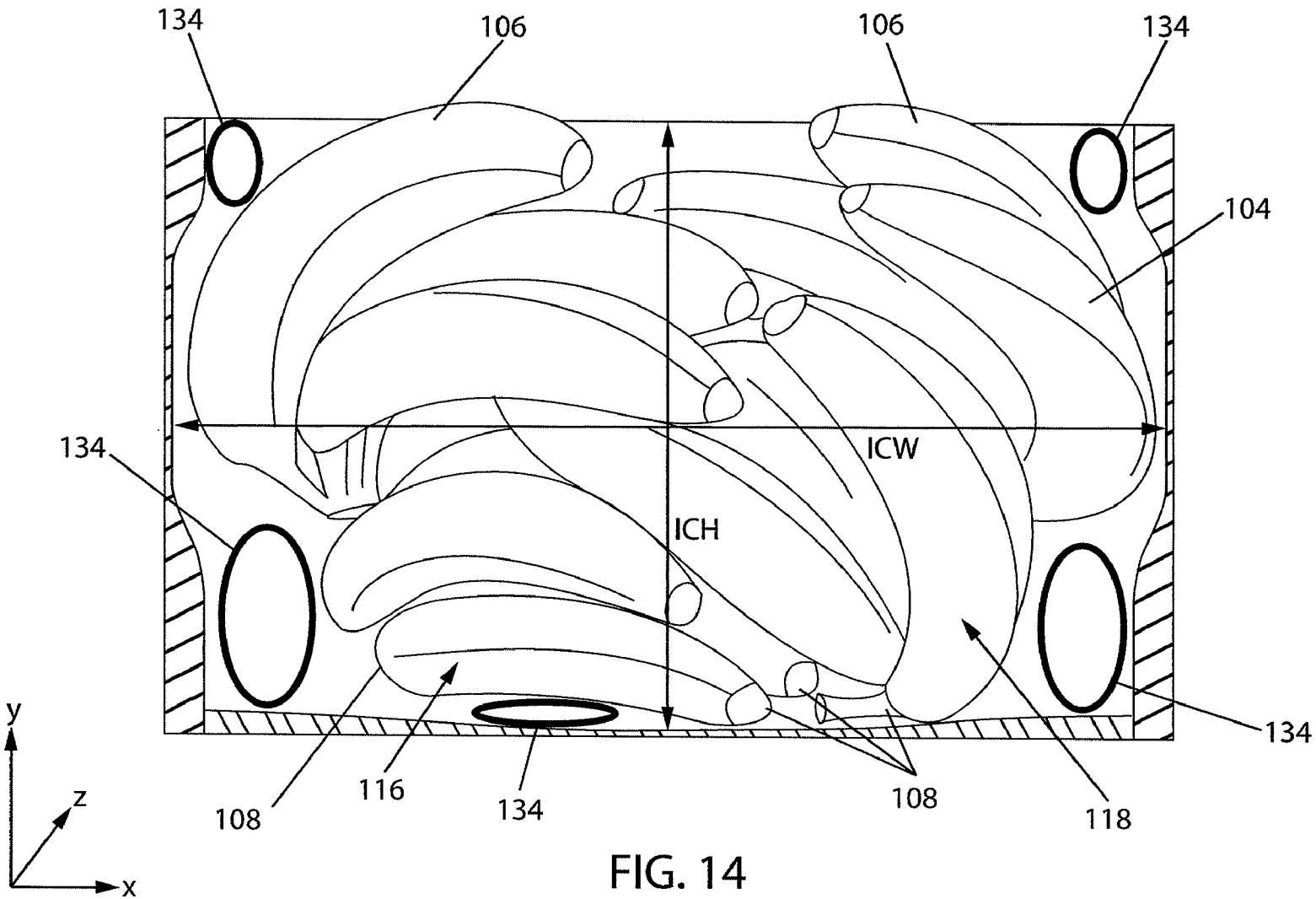
FIG. 14 is a side view of the collapsible container of FIG. 12 holding four clusters of bananas in accordance with one embodiment of the invention.

For example, referring to FIGS. 13 and 14, a cluster of bananas 102 may be shipped using the container 100. Each banana 104 of the cluster 102 may have damage-sensitive portions 106 and damage-resistant portions 108. The damage-sensitive portions 106 may include an easily bruisable body portion (i.e., the portion that contains the edible part), while the damage-resistant portions 108 may include the relatively more durable stems and the ends of the bananas 104. Various embodiments of the invention are directed to containers 100 structured to focus contact between the container 100 and a stored item (e.g., bananas 104) at the damage-resistant portions 108 while reducing contact between the container 100 and the stored item at the damage-sensitive portions 106. In other embodiments, portions of the container 100 that may contact damage sensitive portions 106 of a stored item are configured to adopt a damage-reducing contour or profile.

Turning to FIG. 14, the bananas 104 may be packed in the depicted container 100 by placing a relatively small cluster or first row 116 of bananas along the base 114, followed by a second row 118 that is nested just behind the first row 116. The container 100 is sized and structured such that the first and second rows 116, 118 contact the base 114 only at the damage-resistant portions 108 of the bananas 104. Additional rows of bananas 102 are nested above the second row 118 as shown.

Referring to FIGS. 12 and 14, the depicted container 100 may be sized to correspond to the packed banana arrangement shown in FIG. 14. In this regard, the container 100 may define an internal container width ICW between two opposing sidewalls 112, an internal container length ICL (not shown) between the two other opposing sidewalls 112, and an internal container height ICH between the interior surface of the base and the top edges of the sidewalls 112, as illustrated in FIG. 12. Likewise, the container 100 may define an external container width ECW, an external container length ECL, and an external container height ECH. For cases where the sidewalls 112 and/or the base 114 are contoured (i.e., non-planar), as described below, the relevant dimensions may be measured between the widest points along the surfaces of the container (i.e., the points spaced the farthest from each other), as illustrated in FIG. 14.

More particularly, the depicted container is sized to define maximum internal storage dimensions (in the expanded configuration) ranging between 15 to 17 inches in width, between 19 to 21 inches in length, and between 8.5 to 10.5 inches in height. In one embodiment, a collapsible container structured in accordance with the invention defines maximum internal storage dimensions of approximately 15.9 inches in width, 19.9 inches in length, and 9.5 inches height. In another embodiment, a collapsible container structured in accordance with the invention may define an external footprint having dimensions of approximately 16 inches in width, 20 inches in length, and 9.66 inches in height.

Figure 15:
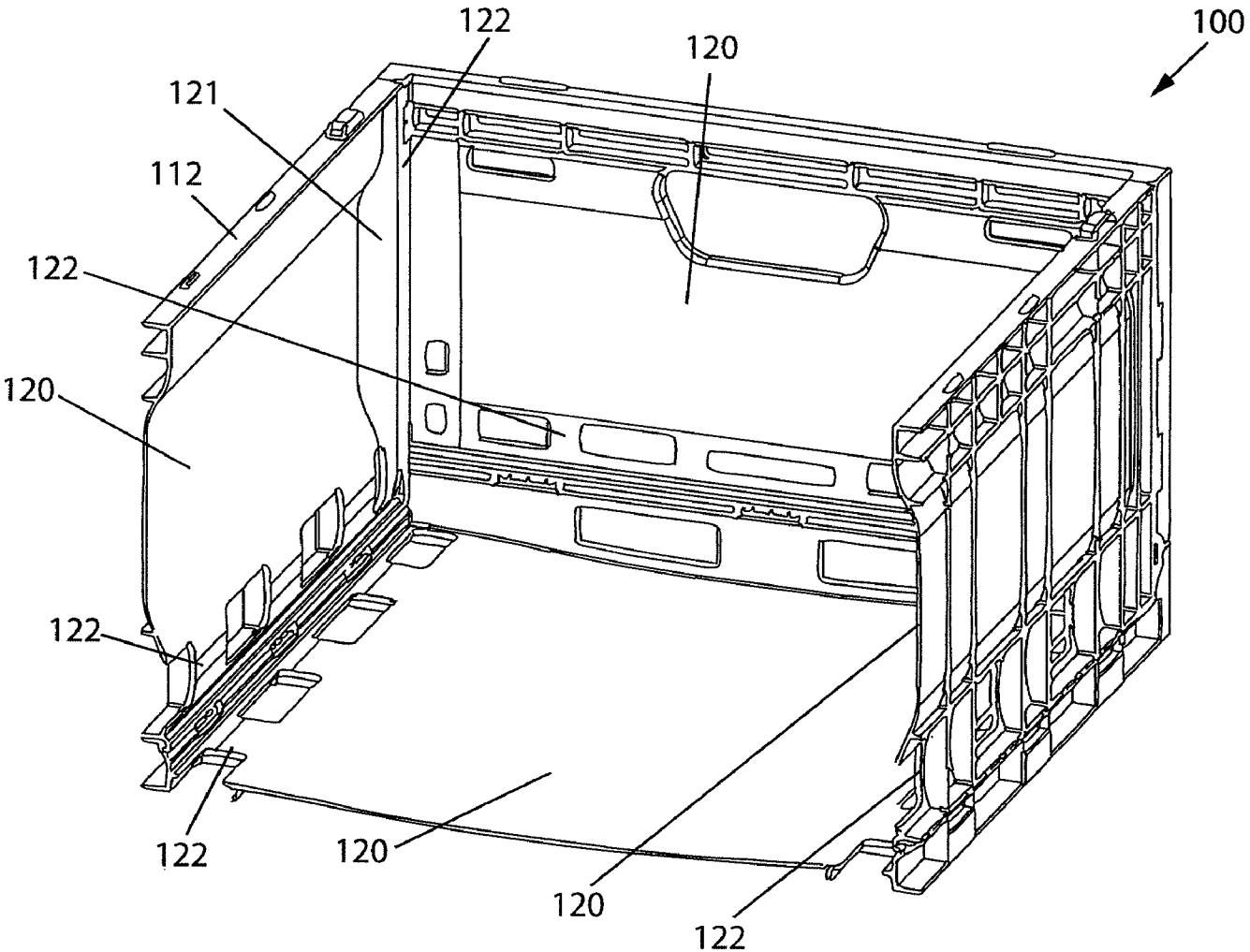
FIG. 15 is a partial perspective view of the collapsible container of FIG. 12 including contact areas and non-contact areas.

In some embodiments, as illustrated in FIG. 15, one or more of the sidewalls 112 of the container define a contact area 120 that is configured to contact stored items carried within the container, and a non-contact area 122 that is not intended to contact the stored items. The base may also define a contact area 120 and a non-contact area 122 as shown. In the depicted embodiment, the contact areas 120 of the sidewalls 112 and the base 114 are located in a generally central region of the sidewalls 112 and base 114. Alternatively, the non-contact areas 122 are located generally outside the central region toward the perimeter of the sidewalls 112 and base 114 as shown.

In various embodiments, the contact area 120 of the walls 112 and/or the base 114 may be structured to define a damage-reducing profile or contour. For example, such contact areas 120 may be smooth, such that no ridges, ribs, textures, protrusions, or other features are present that may impart localized forces from the container to damage-sensitive portions 106 of the bananas or other stored items. In other embodiments, the contact areas 120 may define a scalloped, curved, or contoured cross-sectional profile that conforms or matches, at least to some degree, the packaging contour (e.g., the shape and/or packed configuration) of the item stored within the container. For example, in the depicted embodiment, the contact areas 120 define a curved cross-sectional profile to better match and thereby cradle the generally curved profile of the packed banana clusters.

In addition to being smooth and/or curved, contact areas 120 structured in accordance with various embodiments of the invention may also be substantially continuous. For example, the contact areas 120 may be devoid of openings as shown in FIG. 15. Such openings typically define perimeter edges that might dent, cut, or otherwise damage a stored item. Accordingly, as discussed in greater detail below, such openings may be positioned outside of the contact areas 120.

The contact areas 120 of the depicted sidewalls 112 and base 114 generally define similar damage-reducing contours and/or profiles. In other embodiments, however, the contact area 120 of one sidewall 112 need not match the contact areas 120 of the other sidewalls 112 or base 114. For example, in one embodiment, the base may define a substantially flat but smooth contact area while the contact areas of the sidewalls define substantially curved shapes. In other embodiments, contact areas of differing sidewalls may define differing curvatures in order to match a somewhat irregular profile of a stored item. Various differing contact area configurations will be readily apparent to one of ordinary skill in the art in view of this disclosure.

Figure 16:
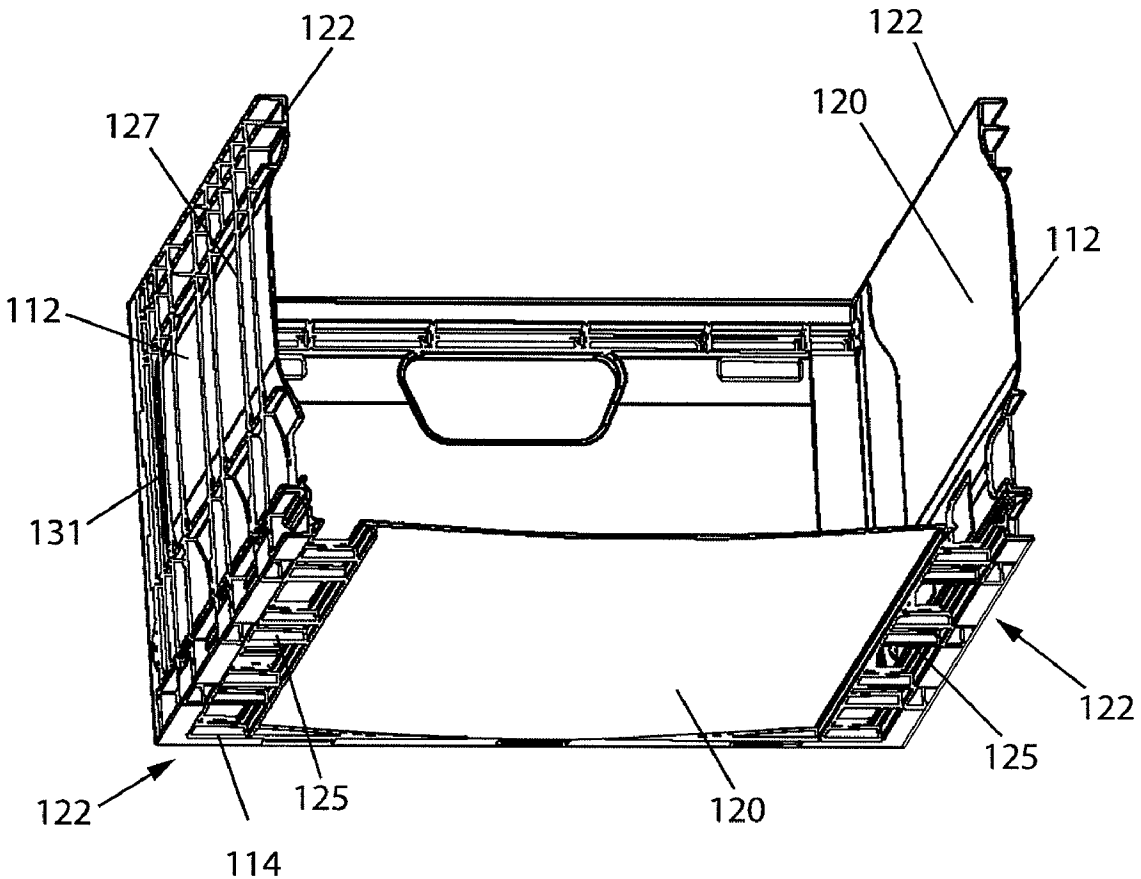
FIG. 16 is a partial perspective bottom view of the collapsible container of FIG. 12.
Figure 18:
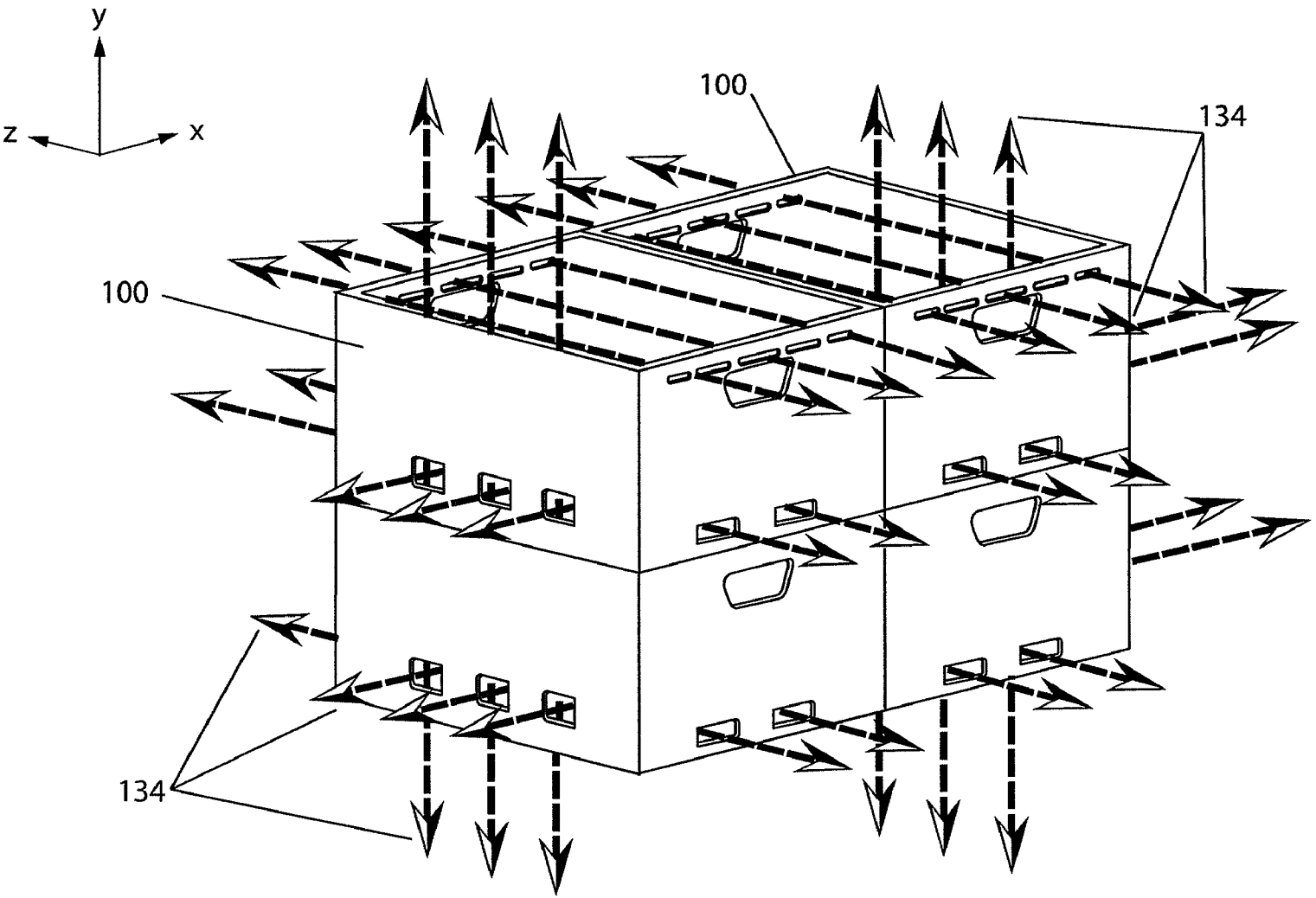
FIG. 18 is a perspective view of a number of collapsible containers in a stacked and side-by-side configuration showing vent flow channels through adjacent containers in accordance with another embodiment of the invention.

During typical handling of containers structured to hold bananas and other items, full containers are often stacked one above the other to facilitate storage and shipping, as illustrated in FIG. 18. As a result, items near the top of the container 100 may come into direct contact with the exterior surface (i.e., bottom surface) of another container 100 stacked directly above. Thus, in some embodiments, the exterior (i.e., bottom) surface of the base 114 may also define a contact area 120 as shown in FIG. 16. Such exterior or bottom contact areas 120 may include damage-reducing profiles or contours of the types discussed above.

Accordingly, in some cases, the base contact area may include an interior portion defined on the interior surface of the base and an exterior portion defined on the exterior surface of the base. The interior portion of the base contact area may thus be structured to contact the items carried by the container, and the exterior contact portion may be structured to contact items carried by an adjacent container (e.g., a container positioned directly underneath the container when the containers are in a stacked configuration such as the configuration shown in FIG. 18). For example, the interior and exterior portions of the base contact area may be substantially smooth and substantially continuous, as described above, so as to reduce the incidence of damage to items carried by the container itself and to items carried by the adjacent container. Furthermore, the interior portion of the base contact area may define a generally concave contour relative to the items carried by the container, and the exterior portion of the base contact area may define a generally convex contour relative to the items carried by the adjacent container, as depicted in FIG. 16.

Various other embodiments of the invention may include ribs or other strengthening and/or stiffening features that are disposed exclusively in non-contact areas 122 or other regions of the container where contact with a stored item is not intended. For example, the container depicted in FIG. 16 includes a rib structure 125 disposed in the non-contact area 122 of the base 114 to better support a load carried in the container and provide greater stiffness to the base 114. The depicted container also includes a rib pattern 127 disposed on the exterior surface (i.e., the surface not intended for stored item contact) of the sidewalls 112. Although not shown, ribs 125 or other strengthening/stiffening features could also be provided in the non-contact areas 122 of the sidewalls 112. For example, one or more of the sidewalls may define a stiffening surface 131 on an exterior surface that includes both contact and non-contact areas.

Figure 17:
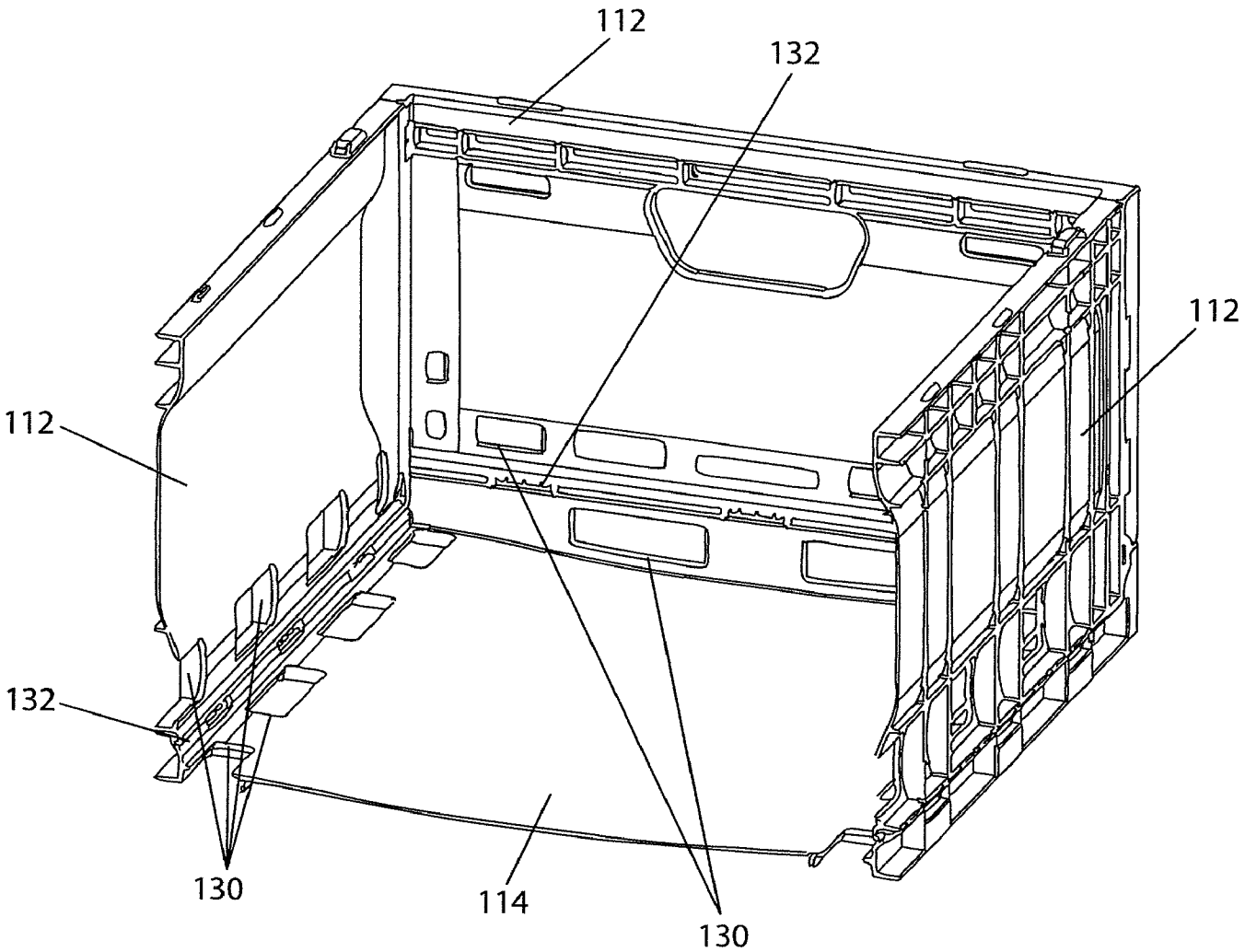
FIG. 17 is a partial perspective view of the collapsible container of FIG. 12 including openings for ventilation in the non-contact areas.

FIG. 17 illustrates a container 100 structured in accordance with yet another embodiment of the invention. The depicted container 100 defines one or more openings 130 disposed in the non-contact areas 122 sidewalls 112 and base 114 to allow a flow of air to pass through the packed container 100. The openings 130 may be defined in the base 114, for example, between the interior and exterior portions of the base non-contact area. In addition, a number of stiffening ribs 125 may be defined in the exterior portion of the base non-contact area.

In one embodiment, openings 130 defined in the non-contact area 122 of one sidewall 112 may be substantially aligned with openings 130 defined in the non-contact area 122 of an adjacent sidewall 112. In another embodiment, openings 130 defined in the non-contact area 122 of a sidewall 112 may be substantially aligned with openings 130 defined in the non-contact area 122 of the base 114. Although not wishing to be bound by theory, such alignment may assist in encouraging air flow through a packed container. As an example, the container may define a total surface area that includes that surface area of the sidewalls 112 and the base 114 (but excludes the top opening) and a total open area that includes the surface area of the openings 130 of the sidewalls 112 and/or the base 114. The inventors have found that a total surface area of the container 100 should have a total open area that is at least between approximately 5% and 10% of the total surface area (for example, approximately 6%) to provide for sufficient ventilation.

Referring to FIG. 14, in another embodiment, by placing the bananas 104 as previously described in order to minimize contact with the base 114 and sidewalls 112 of the container 100, the banana configuration may also serve to facilitate the flow of air through a single container 100 and through multiple stacked and adjacent containers 100. For example, when packaged with the substantially aligned openings discussed above, the configuration of the bananas 104 shown in FIG. 14 may create multiple vent flow channels 134 structured to provide better ventilation for the depicted bananas or other stored items.

Furthermore, alignment of the openings 130 between adjacent containers 100 and containers 100 in a stacked orientation, combined with consistent packing of the bananas 104 in each container 100 to be shipped (as shown in FIG. 14), allows the openings to cooperate to define substantially continuous vent flow channels 134 extending through adjacent containers, as illustrated in FIG. 18. Thus, large shipments of containers 100 may be efficiently stacked and positioned during storage or transit without significantly impairing the flow of air around the bananas contained inside the containers 100 in the x-, y-, and/or z-directions.

Sidewall Latching Features

Figure 19:
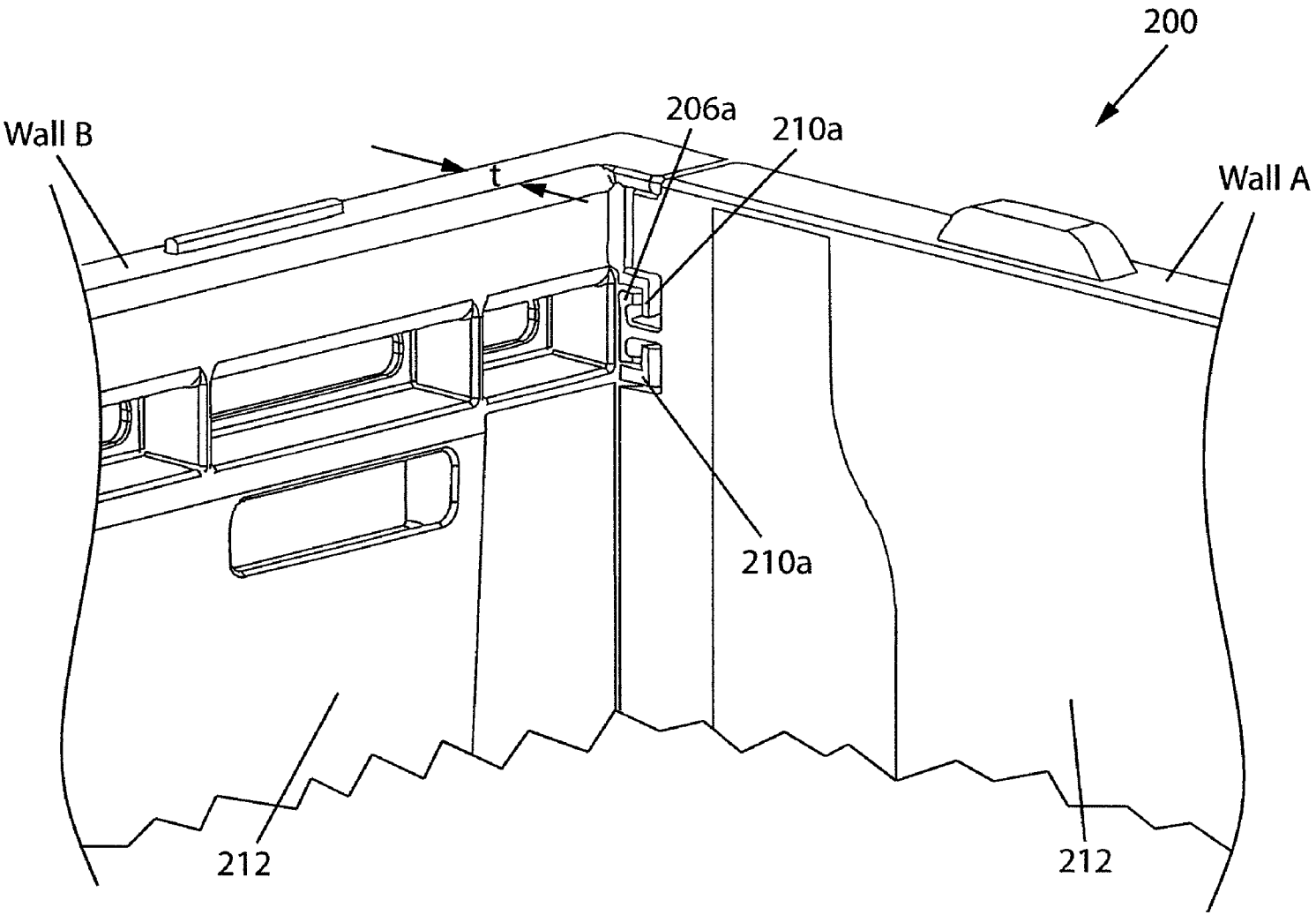
FIG. 19 is a detail perspective view of a pair of latching edges of adjoining sidewalls in accordance with another embodiment of the invention.

In addition to having a hinged or otherwise movable connection between the sidewalls and base, collapsible containers structured in accordance with various embodiments of the invention may incorporate latching features between adjoining sidewalls to allow such containers to securely lock in place in the expanded configuration. Referring now to FIG. 19, the depicted container 200 includes two adjoining sidewalls 212 that are connected via latching protrusions and latching receivers provided along a latching edge of each depicted sidewall 212. For ease of explanation, the figures and description below refers only to a single pair of inter-locking sidewalls. In one embodiment, the first sidewall is referred to as Wall A, and the second sidewall is referred to as Wall B. As will be appreciated by one of skill in the art, collapsible containers are constructed having multiple pairs of inter-locking sidewalls and, thus, may include multiple similar or differently configured latching features for each inter-locking sidewall pair.

Figure 20:
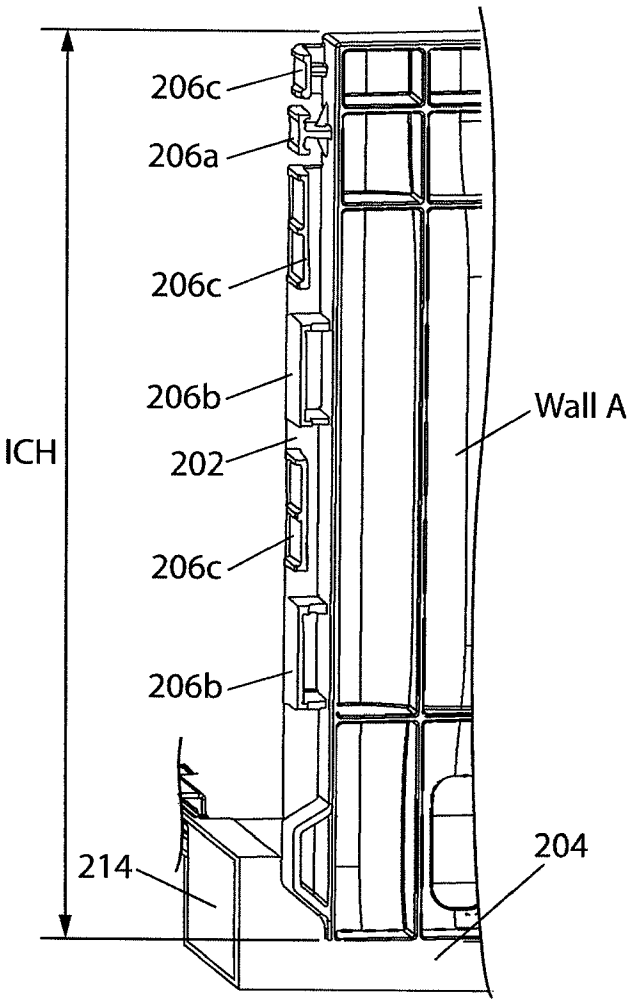
FIG. 20 is a perspective view of the interior surface of a sidewall showing latching protrusions in accordance with one embodiment of the invention.
Figure 21:
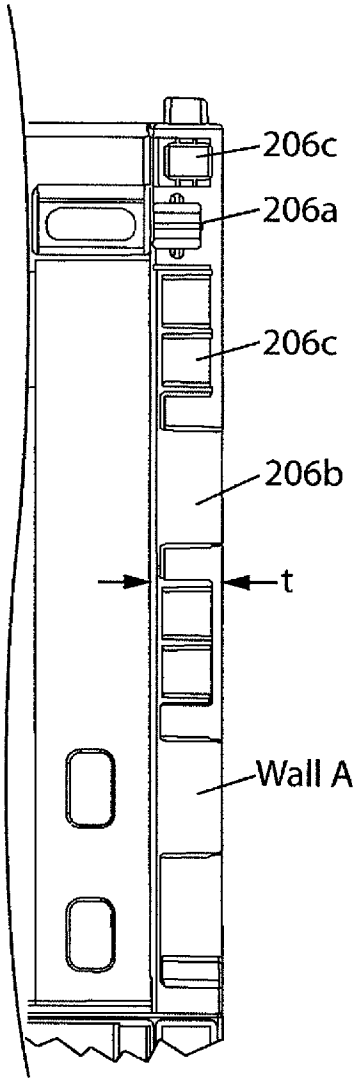
FIG. 21 is a side view of the sidewall of FIG. 20.
Figure 22B:
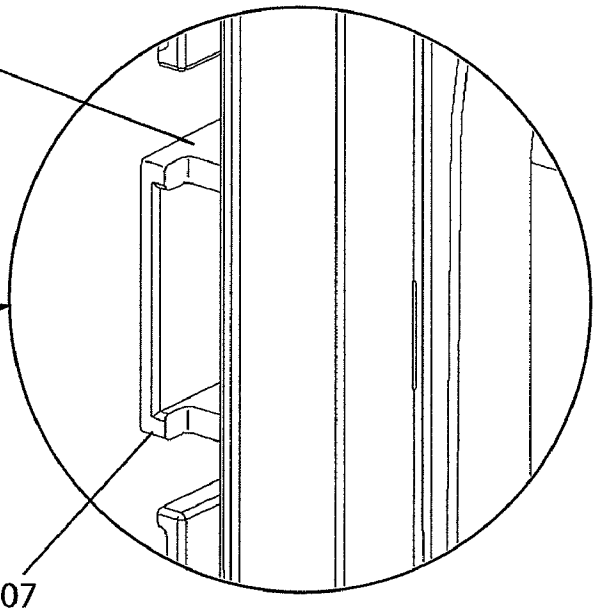
FIG. 22B is a detail perspective view of one of the latching protrusions of FIG. 22A.
Figure 22A:
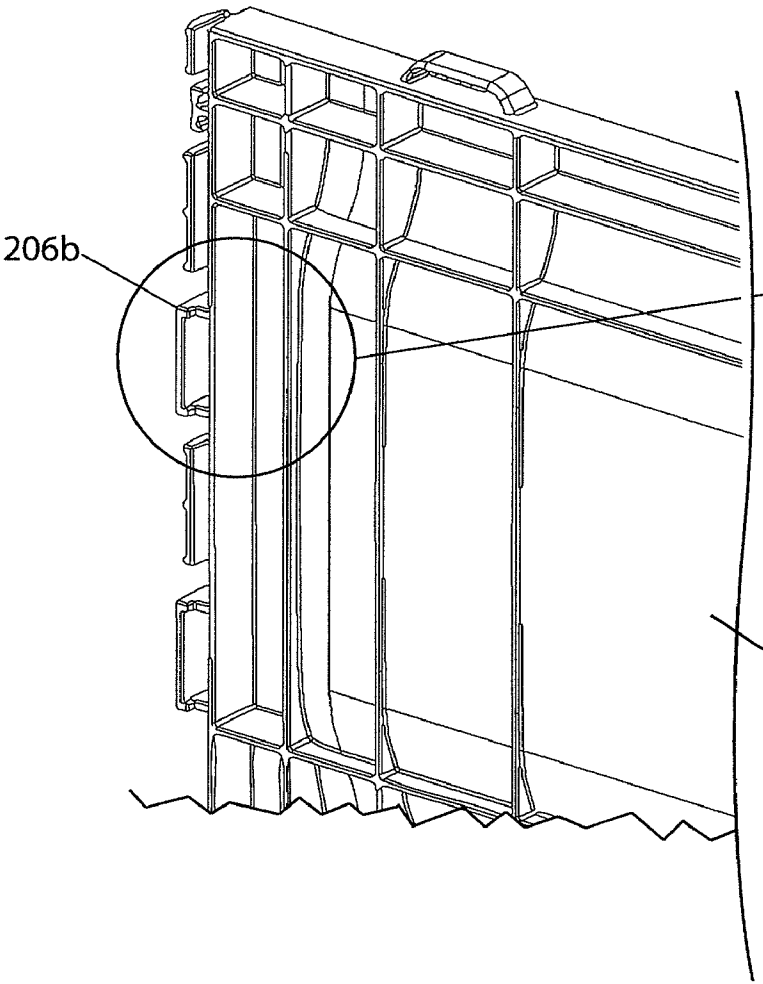
FIG. 22A is a perspective view of the exterior surface of the sidewall of FIG. 20 showing the latching protrusions.

FIG. 20 illustrates a first latching edge 202 defined by Wall A that is substantially perpendicular to a hinged edge 204. Wall A further defines a thickness t (shown in FIGS. 19 and 21). In the depicted embodiment, the latching edge 202 defines one or more latching protrusions 206 that extend along substantially the entire thickness t of the respective wall. In another embodiment, the latching edge 202 defines a plurality of latching protrusions 206 that extend along substantially the entire wall height ICH of the sidewall 212 as shown in FIG. 20. In some embodiments, the latching protrusion 206*a* may define a "T" cross-section as shown. In other embodiments, the latching protrusions 206 may define a "U"-shaped cross-section (206*b*), a linear cross-section (206*c*), or other cross-sections and configurations or combinations of cross-sections and configurations. In one embodiment, one or more of the latching protrusions may define a "U"-shaped cross-section if the section is taken along a plane defined vertically through Wall A, but may define an "L"-shaped cross-section if the section is taken along a plane defined horizontally through the base 214 as shown in FIGS. 22A and 22B.

Figure 23:
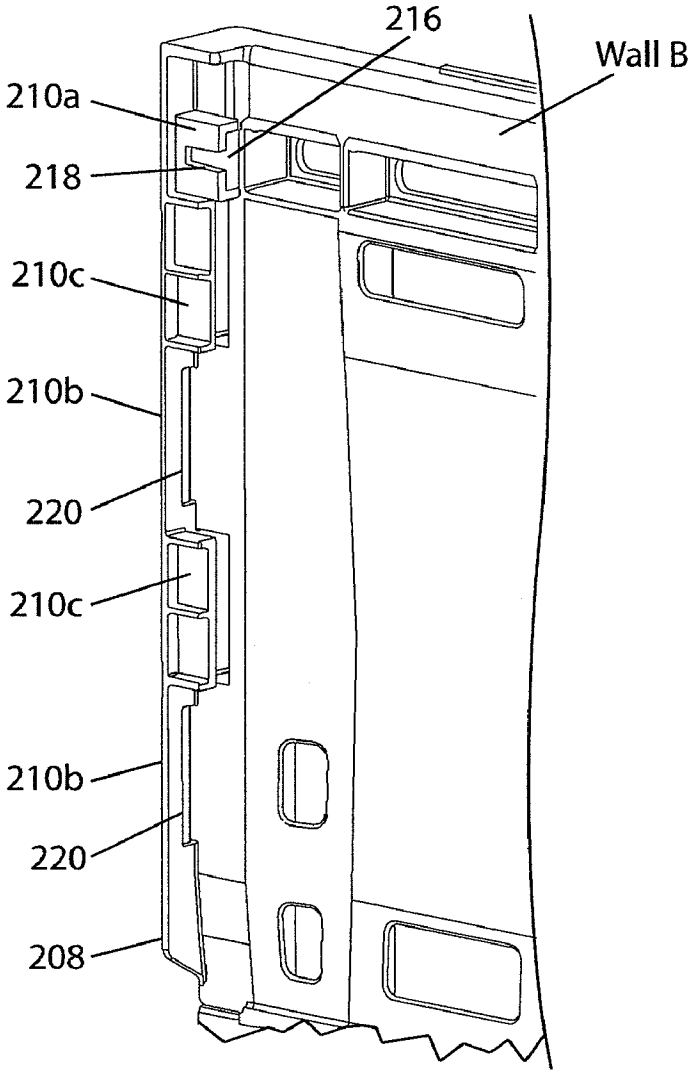
FIG. 23 is a perspective view of the interior surface of a sidewall showing latching receivers in accordance with one embodiment of the invention.
Figure 24:
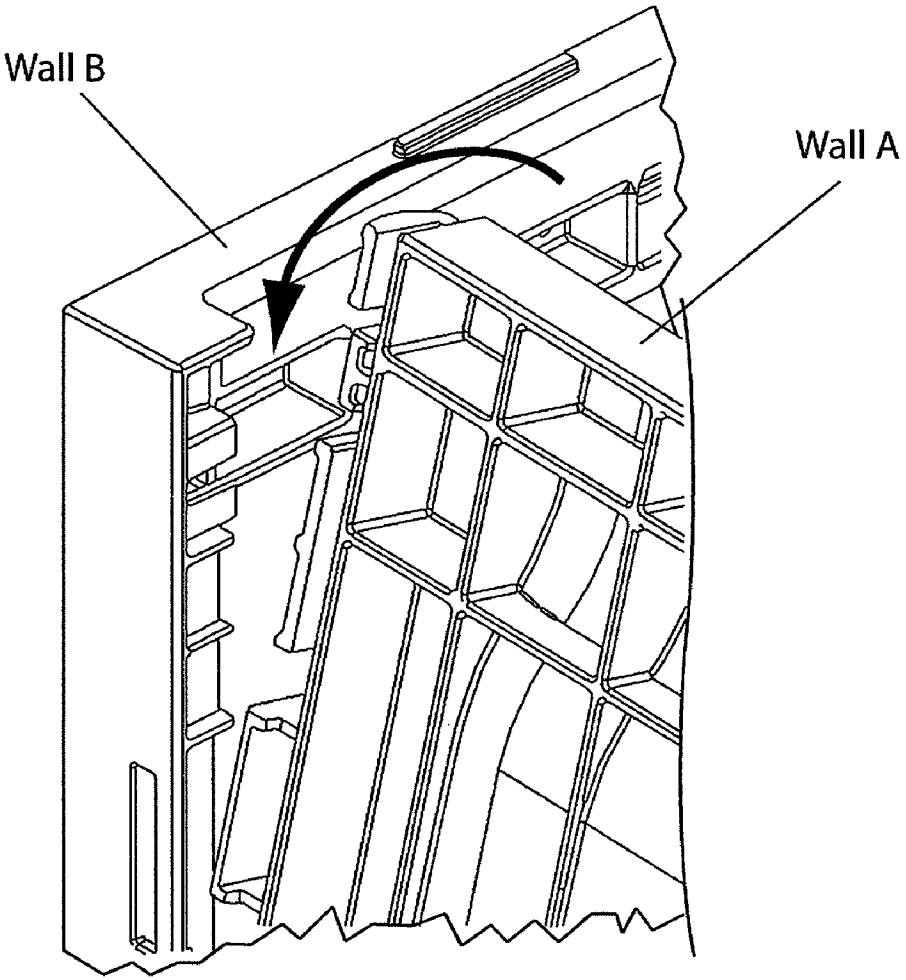
FIG. 24 is a detail perspective view of the exterior surface of the sidewall of FIG. 20 showing the engagement of the latching protrusions with the latching receivers of adjoining sidewalls.

FIG. 23 illustrates a second latching edge 208 defined by Wall B that is substantially perpendicular to a hinged edge 204. Wall B further defines at least one latching receiver 210 configured to receive a corresponding latching protrusion 206 of adjoining Wall A when the container is in the expanded configuration. In one embodiment, the depicted latching receiver 210*a* is configured to receive and engage the corresponding "T" latching protrusion 206*a* and, thus, defines a cavity 216 and slot 218 to accommodate the sliding receipt of the "T" latching protrusion 206*a* with the latching receiver 210*a*. Similarly, the depicted latching receiver 210*b* consists of a slot 220 defined in the second latching edge 208 that is configured to receive and engage an engaging extension 207 of the latching protrusion 206*b* shown in FIG. 22B. The depicted latching receiver 210*c* is configured to substantially mirror the cantilevered latching protrusion 206*c* such that the two arms of the cantilevers frictionally engage one another when Wall A rotates to engage Wall B in the expanded configuration as shown in FIG. 24.

Figure 25:
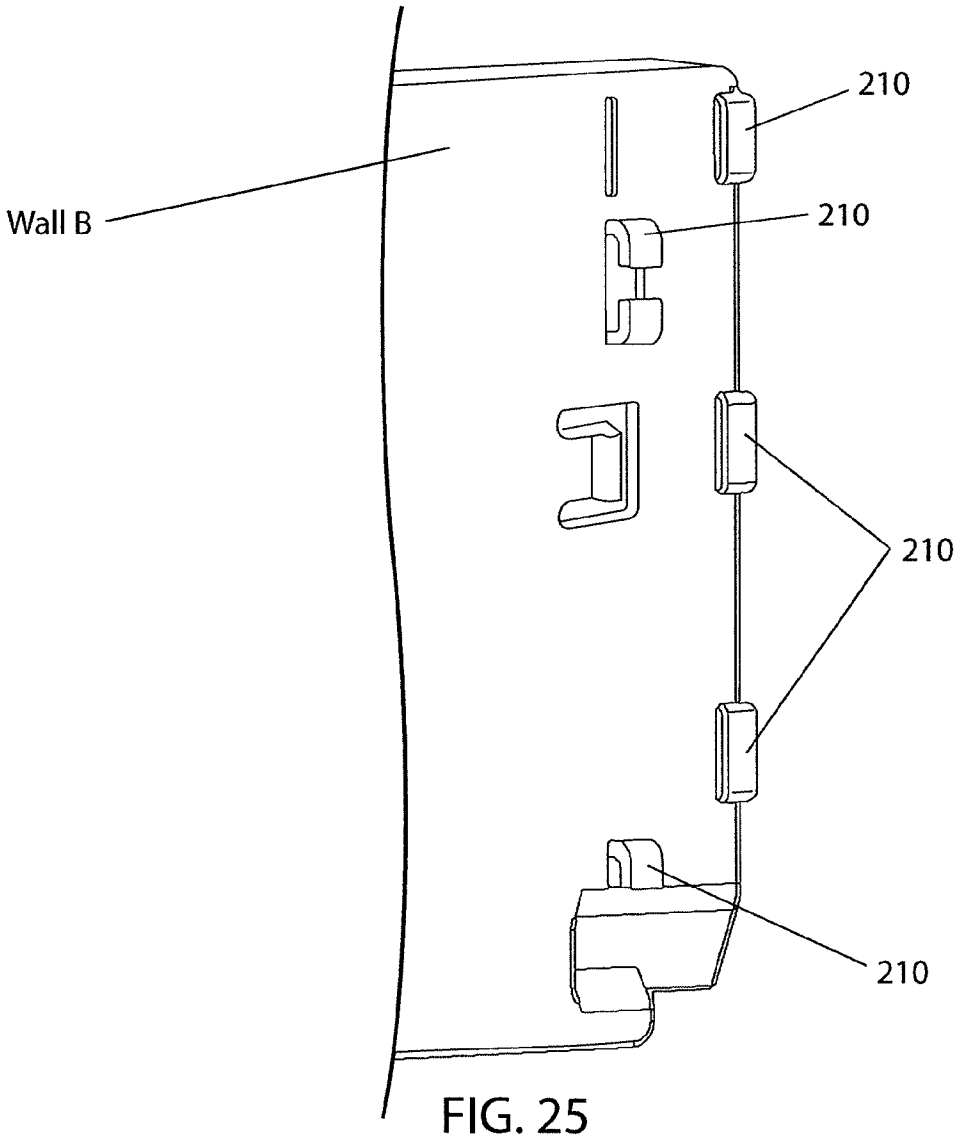
FIG. 25 is a detail perspective view of the interior surface of a sidewall showing latching receivers in accordance with another embodiment of the invention.

Referring to FIGS. 19 and 23, in some embodiments, at least one of the latching protrusions 206 is configured to be received by the corresponding latching receiver 210 proximate the exterior surface of Wall A, and at least one of the latching protrusions 206 is configured to be received by the corresponding latching receiver 210 proximate the interior surface of Wall A. In the example shown in FIGS. 19 and 23, the "T" latching protrusion 206*a* is configured to be received by the corresponding latching receiver 210*a* proximate the interior surface of Wall A. The "U" latching protrusion 206*b* is configured to be received by the corresponding latching receiver 210*b* proximate the exterior surface of Wall A. In this way, adjoining Walls A and B are engaged and supported along the thickness t of Wall A, providing for a more secure and stable engagement between the walls when the container 200 is in the expanded configuration. FIG. 25 illustrates an alternate configuration of latching receivers 210 defined on Wall B for receiving corresponding latching protrusions 206 of Wall A proximate both the interior and exterior surfaces of Wall A.

Figure 26:
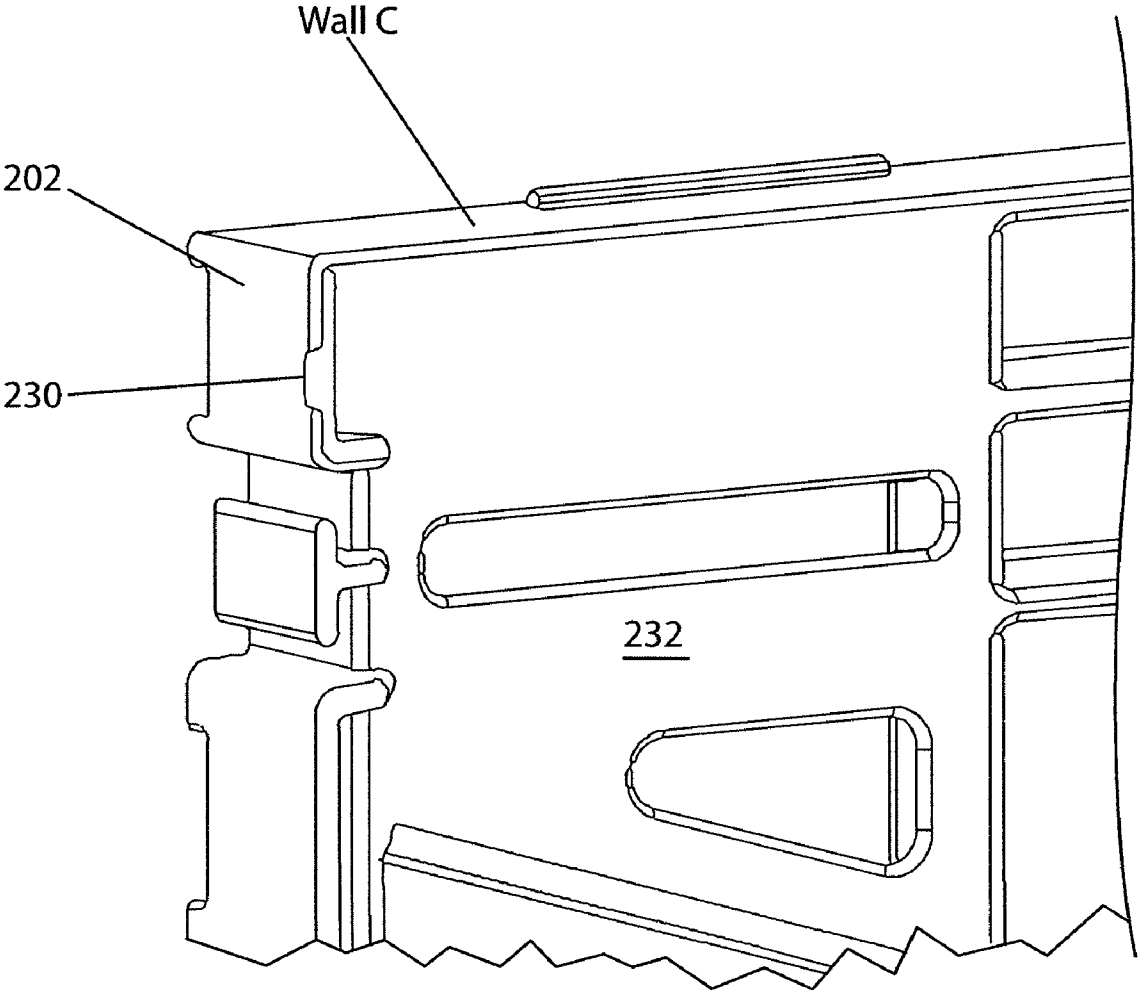
FIG. 26 is a detail perspective view of a latch tab in accordance with one embodiment of the invention.
Figure 27:
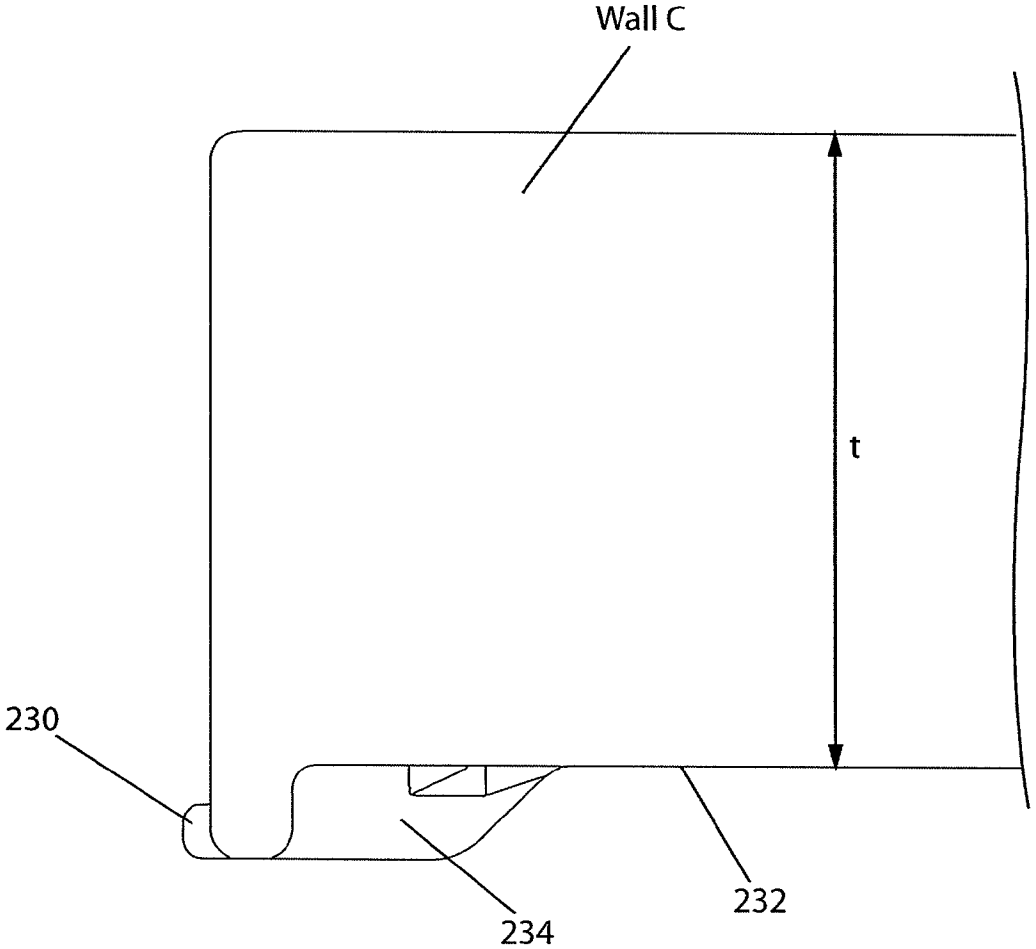
FIG. 27 is a top plan view of the latch tab of FIG. 26.

FIG. 26 illustrates a latching feature structured in accordance with yet another embodiment of the invention. For ease of illustration, the depicted sidewall is referred to as Wall C. Wall C defines a first latching edge 202 and a latch tab 230 proximate an interior surface 232. FIG. 27 provides a top view of the latch tab 230. Wall C defines a thickness t. As shown in FIG. 27, the latch tab 230 may include a tab support 234 extending between the latch tab 230 and the interior surface 232 of Wall C. In this way, the tab support 234 may strengthen the engagement of the latch tab 230 with an adjoining wall, as described more fully below.

Figure 28:
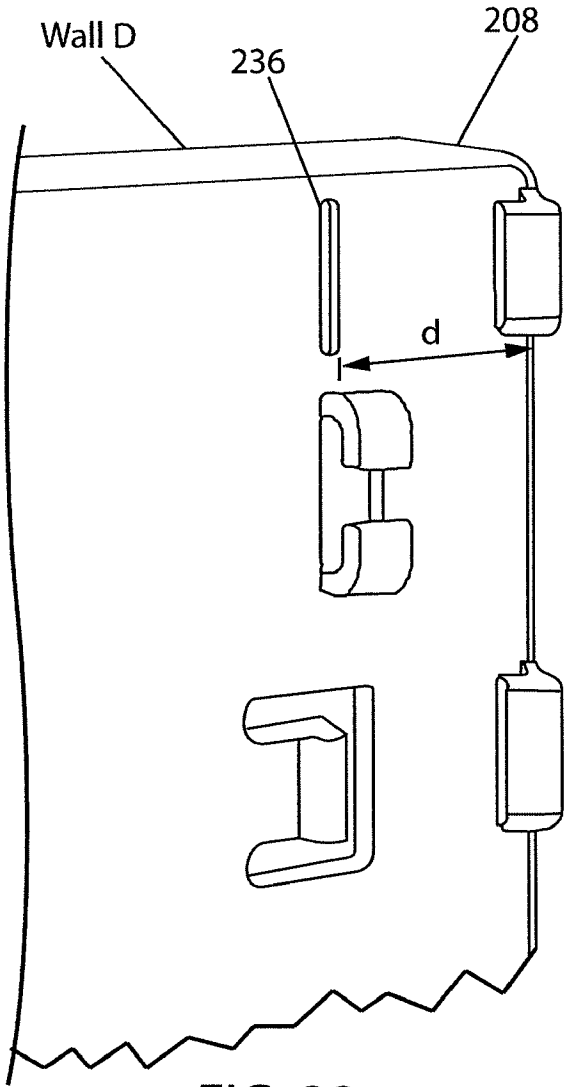
FIG. 28 is a detail perspective view of a tab slot in accordance with one embodiment of the invention.
Figure 29:
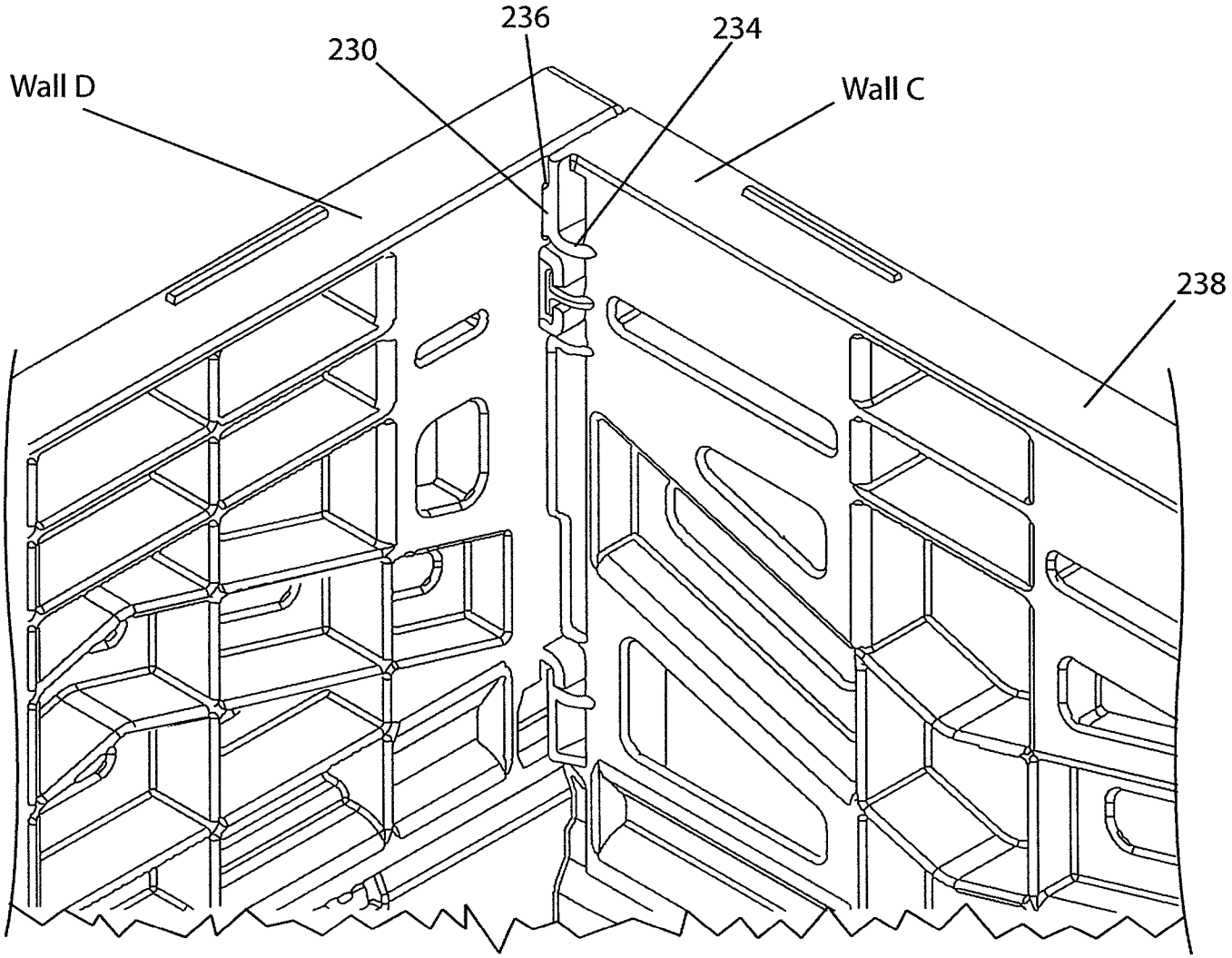
FIG. 29 is a perspective view of the engagement of the latch tab of FIG. 26 with the tab slot of FIG. 28.

FIG. 28 illustrates a sidewall structured to inter-lock or latch to Wall C. For ease of illustration, the depicted sidewall is referred to as Wall D. Wall D defines a tab slot 236 located a distance d from a second latching edge 208 substantially equal to or greater than the thickness t of Wall C. In the depicted embodiment, tab slot 236 is configured to receive the latch tab 230 of Wall C when the container is in the expanded configuration as shown in FIG. 29.

Figures 30A, 30B:
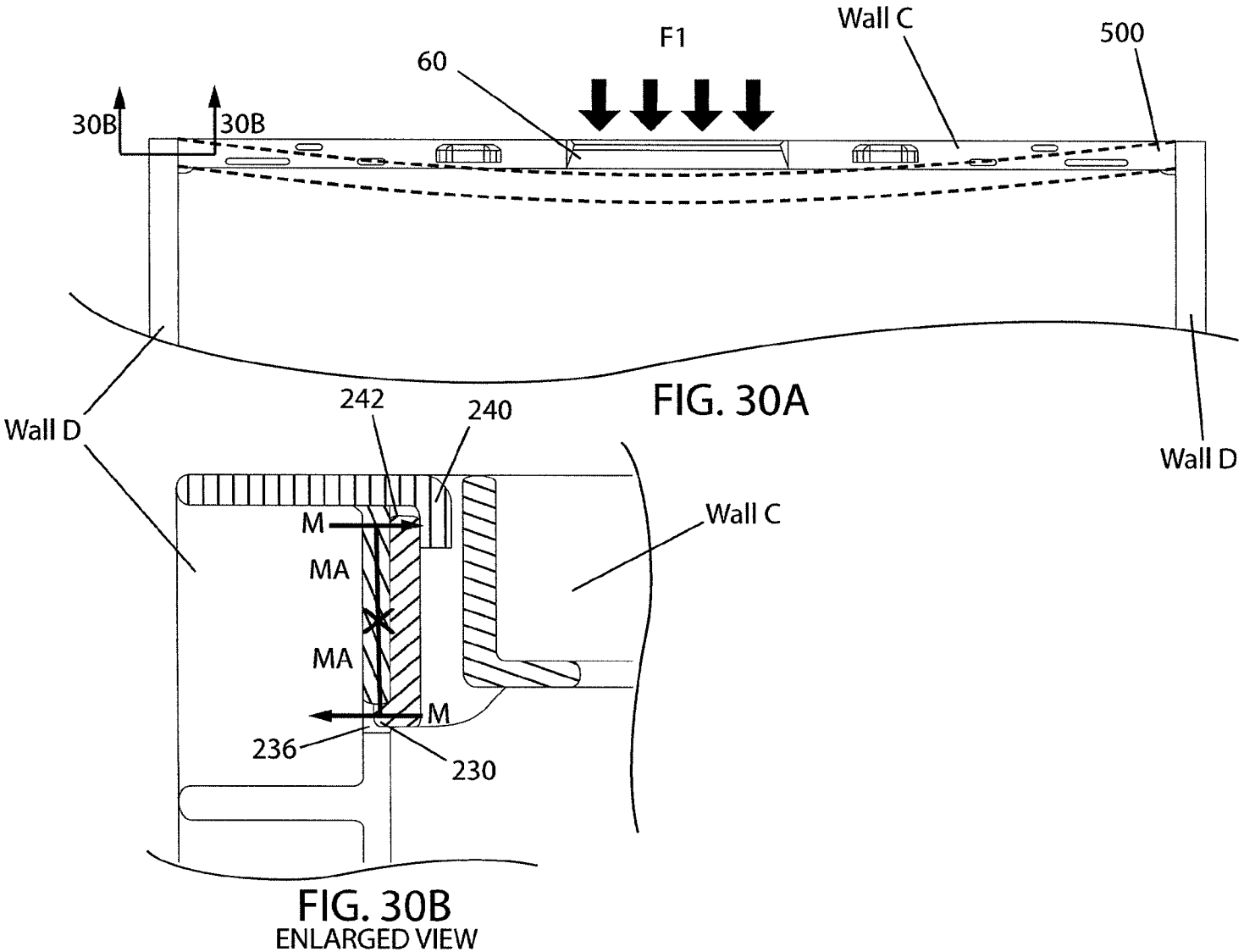
FIG. 30A is a top view of the forces involved in a lifting operation on the side of a collapsible container including a latch tab and tab slot in accordance with one embodiment of the invention.
FIG. 30B is a detail top view of the localized forces at the latch tab and tab slot of FIG. 30A.

FIGS. 30A and 30 B illustrate the interoperability of the latch tab 230/tab slot 236 latching feature structured in accordance with one embodiment of the invention. The location of the depicted latch tabs 230 proximate the interior surface of Wall C, and/or slightly inwardly from the interior surface of Wall C as actually shown in FIG. 30B, creates improved latching performance between Wall C and adjoining Walls D in response to a force F1 generally applied at the midpoint of Wall C as shown. The depicted force F1 is intended to be consistent with a lateral force (or force component) applied by a user grasping the container at handles 60.

In one embodiment, the force F1 applied to the middle region of Wall C encourages a slight curvature of Wall C, which is shown exaggerated for illustration purposes as dashed lines 500. The slight curvature of Wall C tends to slightly shorten the exterior surface of Wall C while slightly extending the interior surface of Wall C, creating moment arms MA and moment forces illustrated by the arrows M of FIG. 30 B. The slight extension of the interior surface of Wall C and/or the moment arm created therefrom tends to ensure that latch tab 230 is driven firmly and, thus, seated securely into tab slot 236. Although only one side of Wall C is shown, a latch tab (not shown) is similarly driven by the interior surface extension and/or moment arm created therefrom into a tab slot (not shown) defined in adjoining Wall D (see FIG. 30A).

In one embodiment, to assist in maintaining engagement of the adjoining Walls C and D during the application of force F1 proximate the exterior of Wall C, a stop 240 may be defined proximate the end of each Wall D as shown. The stop 240 may be configured to receive a corresponding structure 242 defined by Wall C as shown. The stop 240 may be, for example, one of the latching receivers 210 described above in connection with FIGS. 19-25, and the corresponding structure 242 may be one of the corresponding latching protrusions 206.

Figures 31A, 31B:
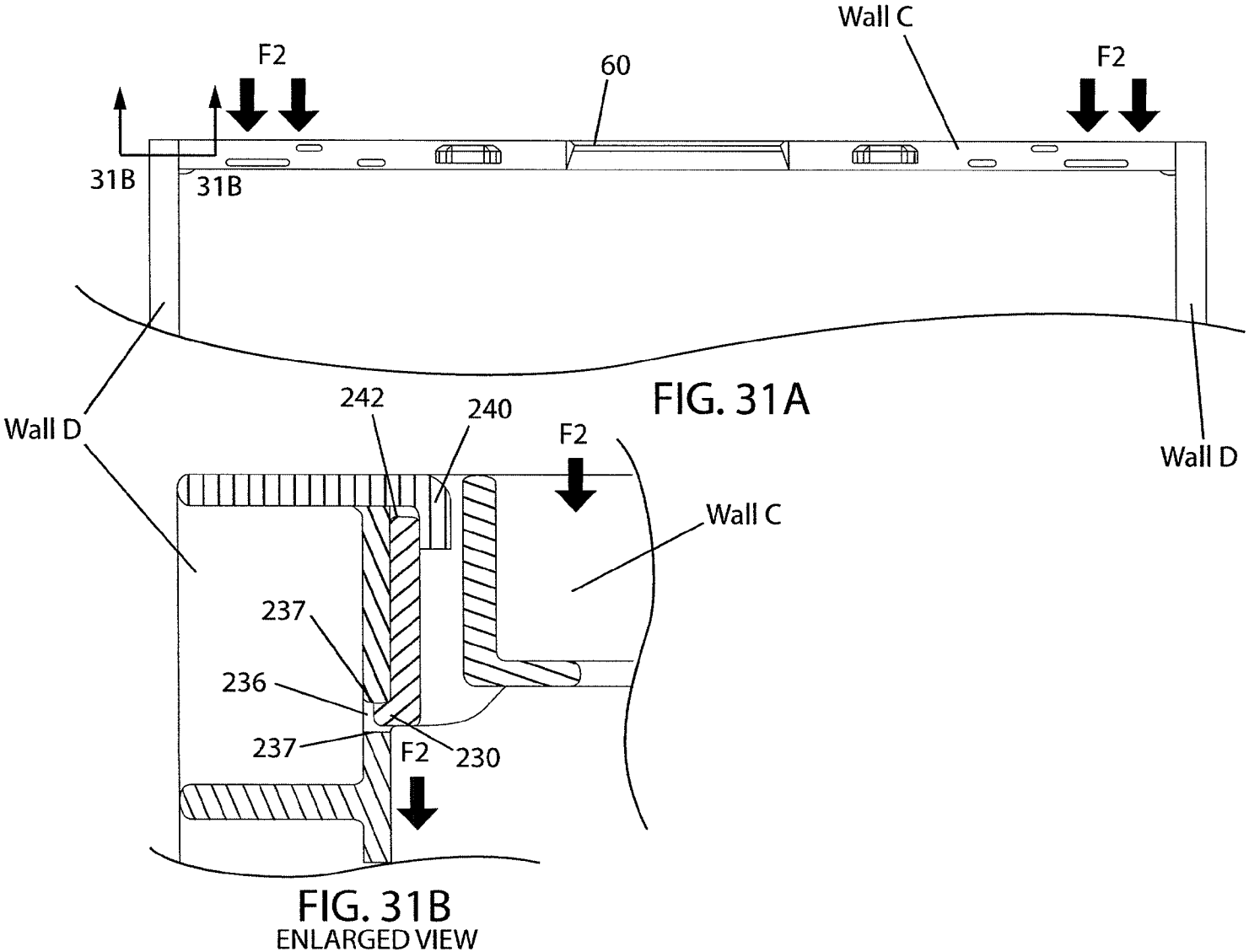
FIG. 31A is a top view of the forces involved in a collapsing operation on the side of a collapsible container including a latch tab and tab slot in accordance with one embodiment of the invention.
FIG. 31B is a detail top view of the localized forces at the latch tab and tab slot of FIG. 31A.

Referring to FIGS. 31A and 31B, the latch tab 230 may be configured to disengage from the tab slot 236 when a force is applied to the exterior surface of Wall C proximate the locations of the latch tabs 230. For example, the application of a force F2, such as by a user pushing Wall C inward at a location proximate a latching edge of Wall C, serves to drive Wall C inwardly without creating the moment arm MA discussed in connection with FIGS. 30A and 30B above. As a result, the latch tab 230 simply disengages from the tab slot 236 as shown in FIG. 31B. In one embodiment, the latch tab 230 may be configured to be somewhat elastic or flexible in order to deflect, at least to some degree, when moving out from the tab slot 236. In another embodiment, the latch tab 230 may define a relatively shortened length (not shown) so as to not extend fully into the tab slot 236 unless a force F1 is applied as discussed above in connection with FIGS. 30A and 30B. Accordingly, a relatively small force F2 may be required to dislodge the shortened latch tab (not shown) from the tab slot 236.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A stabilizing hinge assembly comprising:

a hinge including a hinge member and a hinge receiver configured to receive the hinge member, the engagement of the hinge receiver with the hinge member defining a hinge axis;

a stabilizing ledge fixedly connected to one of the hinge member and the hinge receiver; and a stabilizing hook fixedly connected to the other of the hinge member and the hinge receiver, wherein the stabilizing hook is configured to contact and abut the stabilizing ledge when the stabilizing hook is rotated about the hinge axis to a first position and wherein the stabilizing hook is configured to separate from the stabilizing ledge when the stabilizing hook is rotated about the hinge axis to a second position, wherein the first position and the second position are approximately 90° apart, and wherein abutment of the stabilizing ledge and the stabilizing hook precludes further rotation of the hinge assembly past the first position.

2. The stabilizing hinge assembly of claim 1, wherein the stabilizing ledge comprises:

an undercut portion defining a first engagement surface, and a ledge extension defining a first support surface, and wherein the stabilizing hook comprises:

a hook portion defining a second engagement surface, and a hook extension defining a second support surface, the hook portion of the stabilizing hook being configured to engage the undercut portion of the stabilizing ledge such that the first engagement surface engages the second engagement surface, and the hook extension of the stabilizing hook configured to engage the ledge extension of the stabilizing ledge such that the first support surface engages the second support surface.

3. The stabilizing hinge assembly of claim 2, wherein the first engagement surface and the first support surface are configured to engage the second engagement surface and the second support surface, respectively, substantially simultaneously.

4. A wall comprising:

a base wall portion having a base edge;

a sidewall portion; and the stabilizing hinge assembly of claim 1 pivotally connecting the base edge to the upper wall portion.

5. The stabilizing hinge assembly of claim 4, wherein the stabilizing ledge extends substantially continuously along a length of the respective base edge and the stabilizing hook extends substantially continuously along a length of the respective wall.

6. The stabilizing hinge assembly of claim 4, wherein the stabilizing ledge comprises a plurality of discrete stabilizing ledges dispersed along a length of a respective one of the base edge or the wall.

7. The stabilizing hinge assembly of claim 6, wherein at least two of the stabilizing ledges are positioned on opposite sides of the hinge.

8. The stabilizing hinge assembly of claim 4, wherein the stabilizing hook comprises a plurality of discrete stabilizing hooks dispersed along a length of a respective one of the base edge or the wall.

9. The stabilizing hinge assembly of claim 4, wherein the stabilizing hook is configured to engage the stabilizing ledge along a plane positioned on an opposite side of the hinge axis from the base.

10. A container comprising:

a base having a plurality of base edges; and a plurality of walls;

wherein each of the base edges are pivotally connected to a corresponding wall by the stabilizing hinge assembly of claim 1.

11. A collapsible container having a collapsed configuration and an expanded configuration, the container comprising:

a base defining a plurality of base edges; and a plurality of walls;

wherein each wall includes a hinge member, wherein each base edge includes a hinge receiver configured to receive a corresponding hinge member so as to engage a respective base edge with a corresponding wall such that each wall is rotatable about the corresponding base edge, the engagement of the hinge receiver with the hinge member defining a hinge axis, wherein at least one of the base edges defines a stabilizing ledge fixedly connected to the respective hinge receiver, and wherein at least one of the walls defines a stabilizing hook fixedly connected to the respective hinge member, wherein the stabilizing hook is configured to contact and abut the stabilizing ledge when the stabilizing hook is rotated about the respective hinge axis to a first position, in which the container is in the expanded configuration, and wherein the stabilizing hook is configured to separate from the stabilizing ledge when the stabilizing hook is rotated about the respective hinge axis to a second position, in which the container is in the collapsed configuration, wherein the first position and the second position are approximately 90° apart, and wherein abutment of the stabilizing ledge and the stabilizing hook precludes further rotation of the hinge assembly past the first position.

12. The container of claim 11, wherein the stabilizing ledge comprises:

an undercut portion defining a first engagement surface, and a ledge extension defining a first support surface, and wherein the stabilizing hook comprises:

a hook portion defining a second engagement surface, and a hook extension defining a second support surface, wherein the hook portion of the stabilizing hook is configured to engage the undercut portion of the stabilizing ledge such that the first engagement surface engages the second engagement surface, and the hook extension of the stabilizing hook is configured to engage the ledge extension of the stabilizing ledge such that the first support surface engages the second support surface.

13. The container of claim 12, wherein the first engagement surface and the first support surface are configured to engage the second engagement surface and the second support surface, respectively, substantially simultaneously.

14. The container of claim 11, wherein the stabilizing ledge extends substantially continuously along a length of the base edge, and wherein the stabilizing hook extends substantially continuously along a length of the wall.

15. The container of claim 11, wherein each corresponding hinge receiver and hinge member are configured to cooperate to form a hinge connection.

16. The container of claim 15, wherein the at least one base edge defines a stabilizing ledge on a first side of the hinge connection and a stabilizing ledge on a second side of the hinge connection, and wherein the at least one wall defines a stabilizing hook on a first side of the hinge connection and a stabilizing hook on a second side of the hinge connection.

17. The container of claim 15, wherein a first pair of opposed walls may be rotated about respective hinge connections to a collapsed configuration in which the first pair of opposed walls rests adjacent the base member and a second pair of opposed walls may be rotated about respective hinge connections to a collapsed configuration in which the second pair of opposed walls rests adjacent the first pair of opposed walls.

18. The container of claim 17, wherein a first pair of opposed base edges corresponding to the first pair of opposed walls defines a first height, and wherein a second pair of opposed base edges corresponding to the second pair of opposed walls defines a second height that is different from the first height such that, in the collapsed configuration, the second pair of opposed walls defines a plane that is substantially parallel to a plane of the base.

19. A method of manufacturing a stabilizing hinge assembly comprising:

forming a hinge member;

forming a hinge receiver configured to receive the hinge member;

engaging the hinge member with the hinge receiver to define a hinge axis;

fixedly connecting a stabilizing ledge to one of the hinge member or the hinge receiver; and fixedly connecting a stabilizing hook to the other of the hinge member or the hinge receiver, wherein the stabilizing hook is configured to contact and abut the stabilizing ledge when the stabilizing hook is rotated about the hinge axis to a first position and wherein the stabilizing hook is configured to separate from the stabilizing ledge when the stabilizing hook is rotated about the hinge axis to a second position, wherein the first position and the second position are approximately 90° apart, and wherein abutment of the stabilizing ledge and the stabilizing hook precludes further rotation of the hinge assembly past the first position.

20. The method of claim 19, wherein the stabilizing ledge comprises:

an undercut portion defining a first engagement surface, and a ledge extension defining a first support surface, and wherein the stabilizing hook comprises:

a hook portion defining a second engagement surface, and a hook extension defining a second support surface, the hook portion of the stabilizing hook being configured to engage the undercut portion of the stabilizing ledge such that the first engagement surface engages the second engagement surface, and the hook extension of the stabilizing hook configured to engage the ledge extension of the stabilizing ledge such that the first support surface engages the second support surface.

21. The method of claim 20, wherein the first engagement surface and the first support surface are configured to engage the second engagement surface and the second support surface, respectively, substantially simultaneously.

22. A method of manufacturing a collapsible container, wherein the collapsible container has a collapsed configuration and an expanded configuration, the method comprising:

forming a base defining a plurality of base edges;

forming a plurality of walls;

providing at least one hinge member on each of the walls;

providing at least one hinge receiver on each of the base edges, wherein each hinge receiver is configured to receive a corresponding hinge member so as to engage a respective base edge with a corresponding wall such that each wall is rotatable about the corresponding base edge, the engagement of the hinge receiver with the hinge member defining a hinge axis;

defining a stabilizing ledge on at least one of the base edges, wherein the stabilizing ledge is fixedly connected to the respective hinge receiver, and defining a stabilizing hook on at least one of the walls, wherein the stabilizing hook is fixedly connected to the respective hinge member, wherein the stabilizing hook is configured to contact and abut the stabilizing ledge when the stabilizing hook is rotated about the respective hinge axis to a first position, in which the container is in the expanded configuration, and wherein the stabilizing hook is configured to separate from the stabilizing ledge when the stabilizing hook is rotated about the respective hinge axis to a second position, in which the container is in the collapsed configuration, wherein the first position and the second position are approximately 90° apart, and wherein abutment of the stabilizing ledge and the stabilizing hook precludes further rotation of the hinge assembly past the first position.

23. The method of claim 22, wherein defining the stabilizing ledge comprises:

forming an undercut portion defining a first engagement surface, and providing a ledge extension defining a first support surface, and wherein defining the stabilizing hook comprises:

forming a hook portion defining a second engagement surface, and providing a hook extension defining a second support surface, wherein the hook portion of the stabilizing hook is configured to engage the undercut portion of the stabilizing ledge such that the first engagement surface engages the second engagement surface, and the hook extension of the stabilizing hook is configured to engage the ledge extension of the stabilizing ledge such that the first support surface engages the second support surface.

24. The method of claim 23, wherein the first engagement surface and the first support surface are configured to engage the second engagement surface and the second support surface, respectively, substantially simultaneously.

25. The method of claim 23, wherein defining the stabilizing ledge comprises defining a stabilizing ledge that extends substantially continuously along a length of the respective base edge, and wherein defining the stabilizing hook comprises defining a stabilizing hook that extends substantially continuously along a length of the respective wall.

26. The method of claim 23, wherein each corresponding hinge receiver and hinge member are configured to cooperate to form a hinge connection, wherein defining the stabilizing ledge comprises defining a stabilizing ledge on a first side of the hinge connection and defining a stabilizing ledge on a second side of the hinge connection, and wherein defining the stabilizing hook comprises defining a stabilizing hook on a first side of the hinge connection and defining a stabilizing hook on a second side of the hinge connection.

27. The method of claim 23, wherein the container is configured such that a first pair of opposed walls may be rotated about respective hinge connections to a collapsed configuration in which the first pair of opposed walls rests adjacent the base member and a second pair of opposed walls may be rotated about respective hinge connections to a collapsed configuration in which the second pair of opposed walls rests adjacent the first pair of opposed walls.

28. The method of claim 23, wherein the container is configured such that a first pair of opposed base edges corresponding to the first pair of opposed walls defines a first height, and wherein a second pair of opposed base edges corresponding to the second pair of opposed walls defines a second height that is different from the first height such that, in the collapsed configuration, the second pair of opposed walls defines a plane that is substantially parallel to a plane of the base.

* * * * *

UNITED STATES PATENT AND TRADEMARK OFFICE

CERTIFICATE OF CORRECTION

PATENT NO. : 8,261,923 B2
APPLICATION NO. : 12/427927
DATED : September 11, 2012
INVENTOR(S) : Blanchard It is certified that error appears in the above-identified patent and that said Letters Patent is hereby corrected as shown below:

Title page,
Item (73) Assignee: "Otto Industries North America, Inc., Parsippany, NJ (US)" should read
--Otto Industries North America, Inc., Charlotte, NC (US)--.

Signed and Sealed this
Seventh Day of May, 2013

Teresa Stanek Rea
*Acting Director of the United States Patent and Trademark Office*